US011524821B2

(12) United States Patent
Jelich et al.

(10) Patent No.: US 11,524,821 B2
(45) Date of Patent: Dec. 13, 2022

(54) DISPENSING CLOSURE FOR A CONTAINER

(71) Applicant: AptarGroup, Inc., Crystal Lake, IL (US)

(72) Inventors: Nicholas J. Jelich, Oconomowoc, WI (US); Curt Prusko, Wauwatosa, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 17/286,056

(22) PCT Filed: Feb. 7, 2020

(86) PCT No.: PCT/US2020/017210

§ 371 (c)(1),
(2) Date: Apr. 16, 2021

(87) PCT Pub. No.: WO2020/163714

PCT Pub. Date: Aug. 13, 2020

(65) Prior Publication Data

US 2021/0362919 A1 Nov. 25, 2021

Related U.S. Application Data

(60) Provisional application No. 62/802,975, filed on Feb. 8, 2019.

(51) Int. Cl.
*B65D 47/12* (2006.01)
*B65D 41/26* (2006.01)

(52) U.S. Cl.
CPC ..... *B65D 47/123* (2013.01); *B65D 41/265* (2013.01)

(58) Field of Classification Search
CPC ..... B65D 47/123; B65D 41/265; B65D 2251/0015; B65D 2251/0087; B65D 2251/20; B65D 51/18
See application file for complete search history.

(56) References Cited

U.S. PATENT DOCUMENTS 3,809,276 A * 5/1974 Landen ..... B65D 41/065 215/301
4,475,274 A 10/1984 Beckstrom
(Continued)

FOREIGN PATENT DOCUMENTS

| | | |
|---|---|---|
| EP | 2678245 A1 | 1/2014 |
| GB | 894444 A | 4/1962 |
| JP | 2017128339 A | 7/2017 |

OTHER PUBLICATIONS

Supplementary European Search Report, dated Dec. 9, 2021 in European Patent Application No. EP 20 75 2689.
(Continued)

*Primary Examiner* — Donnell A Long
(74) *Attorney, Agent, or Firm* — Wood, Phillips, Katz, Clark & Mortimer

(57) ABSTRACT

A dispensing closure (40) includes a body (54) for being located at the opening of a container (44) defining a central axis (30) and having a pour spout (72). The body (54) including a crushable seal (200) surrounding the pour spout (72), and the body (54) including a lateral projection (210) extending therefrom. The closure (40) includes a closing element (56) for being removably attached to the body (54) and having a lateral projection (220) extending therefrom. The closing element (56) and the body (54) have a closed condition in which the crushable seal (200) seals between the closing element (56) and the body (54) and the lateral projections (210, 220) are confronting to inhibit separation of the closing element (56) away from the body (54) along the central axis (30).

17 Claims, 32 Drawing Sheets

(56) References Cited

U.S. PATENT DOCUMENTS

| | | | | |
|---|---|---|---|---|
| 4,773,560 | A | 9/1988 | Kittscher | |
| 5,188,249 | A | 2/1993 | Cargile | |
| 5,251,788 | A * | 10/1993 | Moore | B65D 47/123 222/111 |
| 5,379,926 | A | 1/1995 | Mueller et al. | |
| 6,155,462 | A | 12/2000 | Brecheisen et al. | |
| 6,923,341 | B2 | 8/2005 | Smith | |
| 2007/0267383 | A1 | 11/2007 | McGeough et al. | |
| 2019/0270553 | A1 * | 9/2019 | Borger | B65D 47/123 |

OTHER PUBLICATIONS

International Search Report and Written Opinion dated Jul. 16, 2020.

* cited by examiner

DISPENSING CLOSURE FOR A CONTAINER

CROSS-REFERENCE TO RELATED APPLICATION

This application claims priority to U.S. Patent Application No. 62/802,975, filed Feb. 8, 2019, which is incorporated by reference herein in its entirety.

TECHNICAL FIELD

The present invention relates generally to a dispensing closure for use with a container of a fluent substance.

BACKGROUND OF THE INVENTION AND TECHNICAL PROBLEMS POSED BY THE PRIOR ART

Closures are employed to selectively prevent or permit communication between the exterior and interior of a container (e.g., bottle, flexible pouch, vessel, etc.) through an opening in the container. A typical closure includes at least a receiving structure or body arranged at the opening to the container interior, and a closing dement or cap that is cooperatively received by the receiving structure.

The receiving structure of the closure can typically be either (1) a separate structure that can be attached at the container opening, and that defines a passage through the structure for communicating with the container opening and the container interior, or (2) an integral structure that is a unitary portion of the container, and which defines a passage through the structure such that the passage functions as the opening to the container. Also, the closing dement may be formed together with the receiving structure as a unitary article, or the receiving structure and closing element may be separately made and then assembled.

The closing dement typically is movable relative to the receiving structure passage between (1) a closed condition or position for completely, or at least partially, occluding the passage, and (2) an open condition or position for completely, or at least partially, exposing the passage. Some closures may include additional elements (e.g., freshness seals, dispensing valves, tamper-evident features, child safety features, locking elements, etc.).

A closure may be provided on a rigid, flexible, or collapsible container of one or more fluent substances (e.g., liquids, gels, granules, powders, oils, lotions, creams, cleaning products, etc.). The container may be inverted by a user to dispense, or assist in dispensing, the substance from the container through the opened closure. The container with the closure mounted thereon, and the fluent substance or substances stored therein, may be collectively characterized as a "package" that may be encountered by a consumer.

One type of prior art dispensing closure includes a body attached to a container at the container opening, by mating screw threads, snap fit beads, welding, adhesive, etc., and the closure further includes a lid or cap that is screw threaded to the closure body. The inventors of the present invention have noted that such prior art dispensing closures, when installed on a container of a fluent substance, may be susceptible to a likelihood of inadvertent opening during shipping or handling, which can result in premature or messy leaking of the fluent substance stored within the container. For example, the closed lid may be accidentally bumped or twisted open, when subjected to vibrations, a sudden impact, or from internal pressure of a fluent material within the container. The inventors have found that such a likelihood of premature leakage through prior art dispensing closures may be especially pronounced in an e-commerce scenario, whereby an individual package containing a container and the prior art closure is shipped and handled in an unconstrained manner and may be subjected to a variety of forces, orientations, and temperatures.

The likelihood of inadvertent opening of such a closure may be prevented, or at least minimized, by applying an adhesive seal or a film wrap around at least a portion of the closure to mechanically prevent movement of the lid until the seal or wrap has been removed by a user of the closure. However, such additional adhesive seals and film wraps are typically designed and provided for only a "one-time" use (non-reusable) application to withstand lid opening forces during shipping. Moreover, such additional seals or wraps may increase the cost of the closure, require additional manufacturing steps and machinery, or present a nuisance to the user who must remove and discard such a seal.

The inventors of the present invention have determined that it would be desirable to provide a robust closure that may prevent or minimize the likelihood of the inadvertent opening of the closure during shipping or handling. The inventors of the present invention have also determined that, in many applications, it may be desirable to provide such an improved closure that eliminates the need for any additional protective packaging, such as a larger box or carton, or the inclusion of dampening structures or inserts that would otherwise be included to minimize the likelihood of the inadvertent opening of the closure.

The inventors of the present invention have also determined that it would be desirable to provide an improved closure that minimizes the likelihood of inadvertent opening of the closure during shipping or handling and that such an improved closure would open only when engaged by a user applying a specific, yet simple, action to disengage the lid from the body of the closure.

The inventors of the present invention have further determined that, in many applications, it may be desirable to provide an improved closure as part of a package wherein the closure structure facilitates or accommodates the cleaning of the closure and/or minimizes the potential for accumulation of residue, dirt, grime, etc. during the useful life of the package.

The inventors of the present invention have also determined that it would be desirable to provide an improved closure that can be configured for use with a container of a fluent substance so as to have one or more of the following advantages: (1) an improved ease of manufacture and/or assembly, and (ii) a reduced cost of manufacture and/or assembly.

The inventors of the present invention have invented a novel structure for a dispensing closure for use with a container wherein the dispensing closure addresses one or more of the above-described problems, and includes various advantageous features not heretofore taught or contemplated by the prior art.

BRIEF SUMMARY OF THE INVENTION

In one form of the present invention, an improved closure for a container, the container having an opening between an exterior of the and an interior of the container where a fluent substance may be stored, wherein the closure includes a body for being located at the opening of the container. The body defines a central axis and has a pour spout defining an interior surface. The interior surface defines at least a portion of a passage for communicating with the container interior to permit the flow of a fluent substance through the body. The body includes a flexible, crushable seal that is located laterally outwardly of the pour spout, and the body further includes one or more body lateral projections extending laterally from the body.

The closure further includes a closing element for being removably attached to the body and defining an outer wall for being mounted around at least a portion of the pour spout. The closing element further includes a cover that extends laterally inwardly from the outer wall. The closing element includes at least one closing element lateral projection extending laterally from the closing element. The closing element and the body together have a closed condition, wherein in the closed condition (i) the flexible, crushable seal seals between the closing element and the body, and (ii) the body lateral projection confronts the closing element lateral projection to inhibit separation of the closing element away from the body along the central axis.

In one form of the present invention, the closure includes a metallic liner for being sealed between the body and a container. In a presently preferred form of the invention, the body of the closure has at least one liner retention projection extending laterally outwardly therefrom for retaining the metallic liner with the body prior to the metallic liner being sealed between the body and the container.

In another aspect of the present invention, the flexible, crushable seal is integrally molded with the body. In another form of the present invention, the flexible, crushable seal has a frustoconical cross-sectional shape, when viewed in a vertical plane containing the central axis.

According to another aspect of the present invention, the closing element includes an outer flange having an annular sealing surface for sealing against the flexible, crushable seal of the body in the closed condition.

In one form of the present invention, the body includes a top deck from which the flexible, crushable seal extends. The body also includes a recessed well located laterally between the pour spout and the top deck. In one preferred form of the present invention, the recessed well includes at least one drain aperture.

In still another form of the present invention, the body lateral projection includes a circumferentially-extending top portion having an open first end and a closed second end including an axially-extending stop portion. In one preferred form of the present invention, the body includes at least one ramp proximate to the open first end of the circumferentially-extending top portion for limiting rotation of the closing element relative to the closure body in the closed condition.

In yet another aspect of the present invention, the closure is provided in combination with a container of a fluent substance, the substance having a viscosity between about 40 mPa·s and about 600 mPa·s, the dispensing closure, container, and substance together defining a package.

According to one form of the present invention, a portion of the body is formed from a plastic material and the flexible seal is formed from an elastomeric material that is relatively more resilient and flexible than the plastic material.

In yet another aspect of the present invention, the body is one of: a separate structure for being attached to a container at the container's opening; or an integral structure that is a unitary part of a container formed at the container's opening.

In still another aspect of the present invention, the closure further includes a ring-shaped metallic liner that is located axially inwardly of the flexible, crushable seal relative to the central axis of the closure.

In one form of the present invention, the flexible, crushable seal has a tapering, arcuate shape, and it extends from a top deck of the body. The seal defines a radially inwardly facing convex surface and a radially outwardly facing concave surface.

In another form of the present invention, the closing element includes an annular projection which surrounds the flexible, crushable seal when the closing element is in its closed condition mounted atop the body.

In an alternative configuration of the present invention, the flexible, crushable seal has an arcuate shape, extending from a top deck of the closure body, and defines a radially inwardly facing concave surface and a radially outwardly facing convex surface.

In still another form of the present invention, the body includes an annular rim surrounding the flexible, crushable seal and extends axially outwardly of a sealing surface of a portion of the closing element in its closed position.

According to another form of the invention, the closing element lateral projection includes a circumferentially-extending portion having an open first end and a closed second end including an axially-extending stop portion. In a preferred form of the present invention, the closing element includes at least one ramp proximate to the open first end of the circumferentially-extending portion for limiting rotation of the closing element relative to the body in its closed condition.

According to still another form of the invention, the closure includes a body for being located at the opening of a container and defining a central axis. The body includes a wall surrounded by an annular skirt having a screw thread for mating with a screw thread on the container. The body includes a pour spout defining an interior surface and terminates in a pour lip, the interior surface defining a portion of a passage for communicating with the container interior to permit the flow of a fluent substance through the body. The body includes a top deck from which extends a flexible, crushable seal that is located laterally outwardly of the pour spout. The body has a plurality of body lateral projections extending laterally from the body each of which includes an open first end, a closed second end in the form of an axially-extending stop portion, a ramp located in between the open first end and the stop portion. The body includes a liner retention projection that extends laterally outwardly from the wall.

The closure further includes a closing element for being removably attached to the body and including an outer wall for being mounted around at least a portion of the pour spout of the body. The closing element includes a cover that extends laterally inwardly from the outer wall and a flange surrounding the outer wall including an annular sealing surface for engagement with the flexible, crushable seal and having a plurality of lateral projections extending laterally inwardly therefrom for engagement with the body lateral projections.

The closure also includes a ring-shaped metallic liner disposed around the wall proximate the liner retention projection. The closing element and the body have a closed condition, wherein in the closed condition (i) the flexible, crushable seal contacts the sealing surface of the closing element and (ii) each one of the plurality of lateral projections is retained between one of the ramps and one of the stop portions to inhibit separation of the closing element away from the body along the central axis.

In another aspect of the present invention, a body is provided for assembly with a closing element to define a closure for use on a container. The body includes a central axis and includes a pour spout defining an interior surface defining at least a portion of a passage for communicating with a container interior to permit the flow of a fluent substance through the body. The body includes a flexible, crushable seal located laterally outwardly of the pour spout and further includes at least one body lateral projection extending laterally from the body. The body is configured to have a closed condition with a closing element wherein in the closed condition (i) the flexible, crushable seal seals between the closing element and the body, and (ii) the at least one body lateral projection confronts a portion of the closing element to inhibit separation of the closing element away from the body along its central axis. In one preferred form of the invention, the body includes a ring-shaped metallic liner loosely retained around a portion of the body for being sealed between the closure body and the container.

In still another form of the invention, a closure is provided for use with a container, the closure including a body for being located at an opening of the container, and the body defining a central axis. The body includes a pour spout defining an interior surface and at least a portion of a passage for communicating with the container interior to permit the flow of a fluent substance through the body. The body includes a flexible, crushable seal located laterally outwardly of the pour spout. The body further includes at least one retention bead extending radially from the body and located axially inwardly of the flexible, crushable seal for engaging a portion of the container to retain the body at the opening of the container.

The closure further includes a closing element defining an outer wall for being mounted around at least a portion of the pour spout of the body, a cover that extends laterally inwardly from the outer wall, and a means for securing the closing element with a container, preferably in the form of mating screw threads. The closing element and the body have a closed condition, wherein in the closed condition (i) the flexible, crushable seal seals between the closing element and the body, and (ii) the means of the closing element is engaged with a portion of a container to inhibit separation of the closing element away from the body along its central axis.

In one preferred form of the present invention, the flexible, crushable seal has an L-shaped cross-section, when viewed in a vertical plane containing the central axis and defines a radially-outwardly extending upper portion and a radially-outwardly extending lower portion. The upper portion of the seal extends further in a radial direction than the lower portion, with respect to the central axis.

In one preferred form of the present invention, the flexible, crushable seal includes an annular projection that extends axially upwardly from the upper portion of the flexible, crushable seal.

According to yet another aspect of the present invention, the closure includes a body for being located at the opening of a container. The body defines a central axis and a pour spout defining an interior surface and at least a portion of a passage for communicating with the container interior to permit the flow of a fluent substance through the body. The body includes at least one body lateral projection extending laterally from the body.

The closure includes a closing element for being removably attached to the body. The closing element defines an outer wall for being mounted around at least a portion of the pour spout of the body and further includes a cover that extends laterally inwardly from the outer wall, at least one closing element lateral projection extending laterally from the closing element, and a flexible seal extending laterally outwardly from the outer wall. The closing element and the body have a closed condition, wherein in the closed condition (i) the flexible seal seals between the closing element and the body, and (ii) the at least one body lateral projection confronts the at least one closing element lateral projection to inhibit separation of the closing element away from the body along the central axis.

In one presently preferred form of the invention, the flexible seal has the form of a frustoconical, annular extension from the outer wall of the closing element that is configured for sealing against a frustoconical sealing surface of the body.

In another presently preferred form of the invention, the at least one closing element lateral projection includes a circumferentially-extending portion having an open first end, a closed second end including an axially-extending stop portion, and a ramp located proximate to the open first end for limiting rotation of the closing element relative to the body in its closed condition.

In another presently preferred form of the invention, the flexible seal has the form of a frustoconical, annular extension of the outer wall and it includes an axially-extending sealing portion for sealing against a frustoconical sealing surface and an annular, vertical sealing surface projecting axially upwardly from a top deck of the body.

In another preferred form of the present invention, the closure further includes a metallic liner for being sealed between the body and a container. The body more preferably includes at least one liner retention projection extending laterally outwardly therefrom for retaining the metallic liner with the closure body prior to the metallic liner being sealed between the body and the container.

In yet another form of the present invention, the flexible seal is integrally molded with the body. In a preferred form of the present invention, the body includes a drain aperture.

In still another form of the present invention, the closure is in provided in combination with a container of a fluent substance having a viscosity between about 40 mPa·s and about 600 mPa·s, the dispensing closure, the container, and the substance together defining a package. In one preferred form of the invention, the body is one of: a separate structure for being attached to a container at the container opening; or an integral structure that is a unitary part of a container formed at the container opening. In another form of the present invention, the closure further includes a ring-shaped metallic liner located axially inwardly of the flexible seal relative to its central axis with the closing element in its closed position.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 2 shows the opening of the container;

FIG. 7 shows the closing element of the closure removed from a closed condition relative to the closure body;

FIG. 9 shows the closure body and a loosely retained liner, together as a subassembly, prior to installation at the opening of a container;

DESCRIPTION OF THE PREFERRED EMBODIMENTS

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

Figure 1:
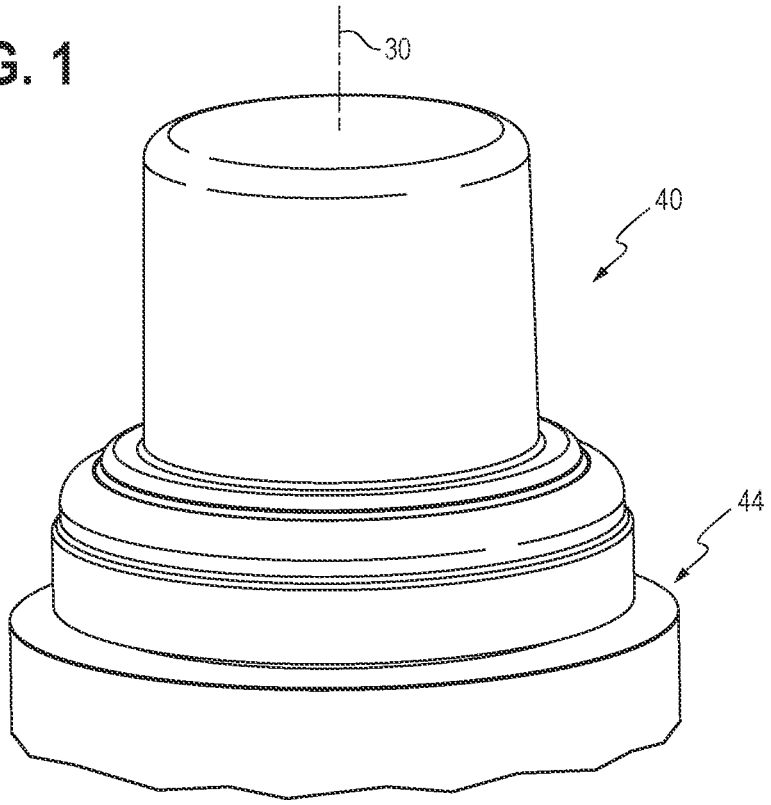
FIG. 1 is an isometric view, taken from above; of a first illustrated dispensing closure of the present invention installed at the opening of a container, and FIG. 1 only shows a fragmentary portion of the upper end of the container.
Figure 2:
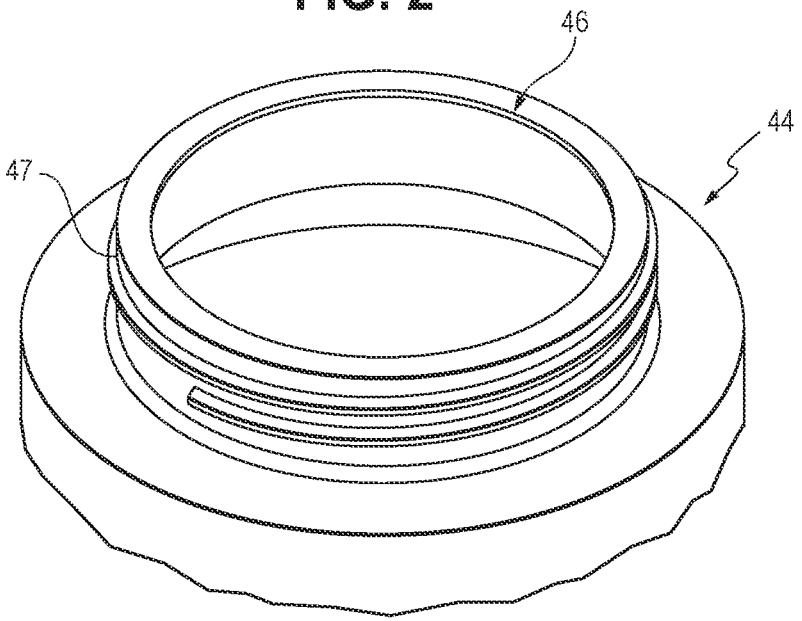
FIG. 2 is an isometric view, taken from above, of the fragmentary portion of the container illustrated in FIG. 1.
Figure 3:
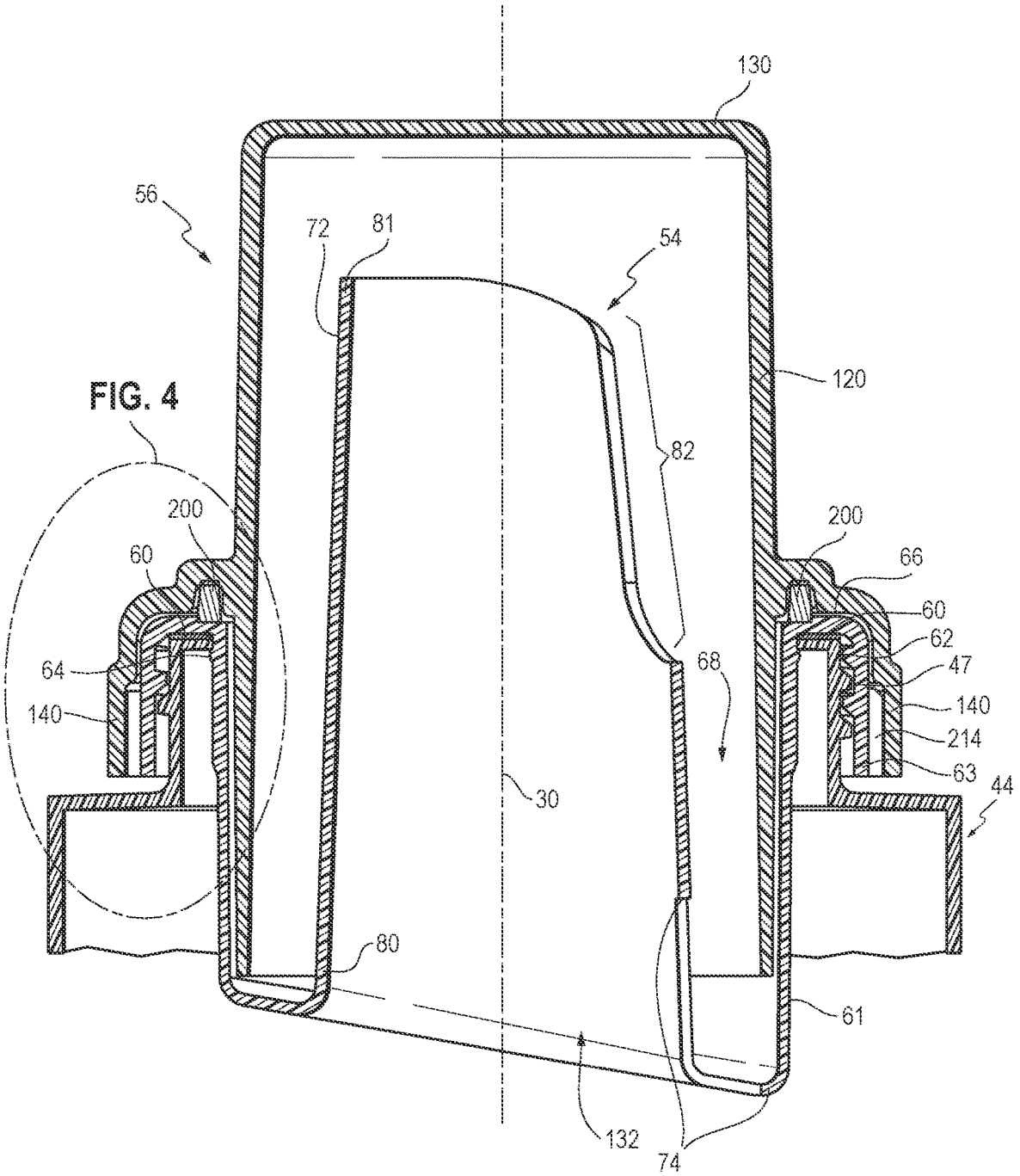
FIG. 3 is a cross-sectional view of the dispensing closure and container illustrated in FIG. 1, taken generally along a vertical plane extending through and containing a central axis defined by the closure.

With reference to FIGS. 1 and 3, for ease of description, many figures illustrating the invention show embodiments of a dispensing closure (which may be referred to herein as a "closure") in the typical orientation that the closure would have when located at the opening of a container, where the illustrated container is in the form of an upright bottle having an opening in its upper or top end, and terms such as "inward", "outward", "upper", "lower", "axial", "radial", "lateral", etc., are used with reference to this orientation. The term "axially inward" is to be understood as in the direction downward along a central axis 30 that is defined by the closure 40, toward the interior of the container 44 (visible in FIGS. 1 and 3). The term "axially outward" is to be understood as in the direction upward along the central axis 30 of the closure 40, away from the interior of the container 44. The term "radially inward" is to be understood as in the radial direction toward the central axis 30 of the closure 40. The term "radially outward" is to be understood as in the radial direction away from the central axis 30 of the closure 40. The term "laterally inward" is to be understood as in a direction toward the central axis 30 of the closure 40, in a plane normal to the central axis 30. The term "laterally outward" is to be understood as in a direction away from the central axis 30 of the closure 40, in a plane normal to the central axis 30. It will be understood, however, that the closures of this invention may be manufactured, stored, transported, used, and/or sold in an orientation other than the orientation described and illustrated.

The closures of this invention are especially suitable for use with a variety of conventional or special containers, the details of which, although not fully illustrated or described, would be apparent to those having skill in the art and an understanding of such containers. The particular containers described and illustrated herein are not intended to limit the present invention. It will also be understood by those of ordinary skill that novel and non-obvious inventive aspects are embodied in the described closures alone.

The closures described herein are especially suitable for use on a container that contains a fluent material or substance in the form of a liquid detergent or soap that can be dispensed, or otherwise discharged, from the container through the opened closure. Such fluent substances may be, for example, a personal care product, a food product, an industrial product, a household product, or other types of products. Such substances may be for internal or external use by humans or animals, or for other uses (e.g., activities involving medicine, commercial or household maintenance, agriculture, manufacturing, etc.).

A first embodiment of a dispensing closure of the present invention, and/or its components, are illustrated in FIGS. 1-12, wherein the closure (or the assembly of its components) is designated generally by the reference number 40. The first illustrated embodiment of the closure 40 has the form of a separate article of manufacture that is configured to be attached or assembled to a container 44 at the container opening 46 (visible in FIG. 2), the container having the form of a bottle that would typically contain a fluent substance.

It will be understood that the container may be any conventional type, such as a collapsible, flexible pouch, or may be a generally rigid bottle that has somewhat flexible, resilient walls. The container, or a portion thereof, may be made from a material suitable for the intended application. For example, the container may be a pouch made from a thin, flexible material, wherein such a material could be a polyethylene terephthalate (PET) film or a polyethylene film and/or an aluminum foil. Alternatively, a more rigid container in the form of a bottle could be made from a thicker, less flexible material such as molded polyethylene, polypropylene, polyethylene terephthalate, polyvinylchloride, glass, metals, or other materials.

In applications wherein the closure is mounted to a container such as a bottle, it is contemplated that typically, after the closure manufacturer would make the closure (e.g., by molding the closure from a thermoplastic polymer), the closure manufacturer will then ship the closure to a container filler facility at another location where the container is either manufactured or otherwise provided, and where the container is filled with a product prior to installation of the closure. If the container is a collapsible pouch, then the closure may include a suitable fitment portion that can be sealed or otherwise attached to the pouch as the pouch is being made and filled, or as the pouch is being made but before the pouch is subsequently filled through the open closure or through open regions of the pouch walls that are later sealed closed.

In the first illustrated embodiment of the closure 40 in FIGS. 1-12, the closure 40 is provided as a separately manufactured article, component, or unit for being screw threaded onto threads 47 (FIGS. 2 and 3) at the opening 46 of the container 44. In some applications, it may be desirable for the closure 40 to be snap fitted onto a container or attached to a container by welding, adhesives, etc. in a manner that would not allow a user to easily remove the closure 40. Further, it may be desirable for the closure (or at least the body of the closure) to be formed as a unitary part, or extension, of the container wherein such a unitary part or extension simultaneously defines an end structure of the container, per se.

The container, per se, does not form a part of the broadest aspects of the present invention. The container may have any suitable configuration.

The first illustrated embodiment of the closure 40 depicted in the FIGS. 1-12 is especially suitable for use with a container that is a large bottle having somewhat rigid walls wherein the contents of the container can flow under the force of gravity from the inside of the container through the opened closure and to an exterior of the container.

In other applications, it may be desirable to pressurize the container interior at selected times with a piston or other pressurizing system (not illustrated), or to reduce the exterior ambient pressure to suck the material out through the open closure. In some other applications, it may be desirable to also accommodate filling or refilling of the container with the fluent contents through the opened closure 40 into the container interior.

With reference now to FIG. 3, the dispensing closure 40 includes the basic components of a hollow closure base or body 54 for being located at the opening of a container, a cap or closing element 56 removably or releasably connected to the body 54, a metallic liner 60 disposed and sealed between the body 54 and the container 44 upon which the closure 40 is installed. A sealing means or structures are provided between the body 54 and the closing element 56 which cooperates with a retaining means or structures between the body 54 and the closing element 56 to prevent or at least minimize the probability of premature opening of the closing element 56 relative to the body 54, both the sealing means and the retaining means are discussed in detail hereinafter. In some applications, the liner 60 may be omitted.

The closure body 54 and closing element 56 components (discussed in detail below) are preferably formed or molded as separate structures from a suitable rigid thermoplastic material such as polypropylene ("PP") or polyethylene ("PE"). Other materials may be employed instead. The sealing means is preferably molded or formed with the closure body 54, such as by bi-injection molding, from a suitable resilient, elastomeric material such as an injection moldable grade of thermoplastic elastomer ("TPE"). Other materials may be employed instead.

The liner 60 is depicted in the Figures has having an annulus or ring-like form that may be disposed between, and bonded or otherwise attached to, both a portion of the closure body 54 and the upper end of the container 44 to provide a tamper-evident seal and/or a substantially permanent seal between the closure body 54 and the container 44. Such a seal may also prevent or minimize the probability of out-leakage of the product to the ambient environment or in-leakage from the ambient environment of atmospheric gases or other substances (which could be liquid, solid or gaseous contaminants). Some liners may be manufactured by providing a sheet of liner material having a metallic (e.g., aluminum) substrate layer, and punching or stamping the sheet of liner material to create a generally annular configuration or other configuration having a through hole that is defined by one or more cut edges that are exposed to the open interior of the container. U.S. Pat. No. 8,573,423, which is incorporated by reference herein in its entirety, discloses such a liner wherein the metallic substrate layer (e.g., aluminum foil) is sandwiched between, and attached to, two outer, heat-sealable thermoplastic layers. The metallic substrate layer of the liner functions to heat up in an induction heating system through which the assembly of the closure, liner, and top end of the container pass so as to fuse and heat seal (bond) each of the two, outer, heat-sealable layers to a respective one of the closure body 54 and container 44.

Although a metallic layer is not required in a liner 60 that is to be installed using other processes such as adhesive or conduction heat bonding (instead of induction heat sealing), such other bonding processes could be employed even with liners that have a metallic substrate layer (that in such an application would not serve an induction heating function).

In the Figures, the liner 60 is shown in a simplified manner for ease of illustration, wherein the liner 60 is shown as a single metallic structure. It will be understood that the liner 60 would be much thinner relative to the closure body 54, the closing element 56, and the container 44, and would have a metallic substrate layer disposed between at least a pair of heat-sealable polymer layers that can be bonded together by suitable means, including thin film adhesive layers. Further, it will be understood that the metallic substrate layer and/or the heat-sealable layers can be composed of a plurality of thinner layers (i.e., a plurality of thinner strata, sub-layers, or laminae).

The separately formed components of the body 54, closing element 56, and liner 60 are subsequently assembled into the dispensing closure 40. It will be understood that in alternative designs (not illustrated), one or more of the basic components or sub-components may be separately or sequentially formed or molded (such as through bi-injection molding). Alternatively, the basic components may be molded initially as one connected structure, and then broken apart, and then re-assembled into an operative combination. Further, it will be understood that in an alternate embodiment (not illustrated), the body 54 may be unitarily formed or molded as an extension of the open end of the container 44 and need not be a separately formed article of manufacture.

Figure 7:
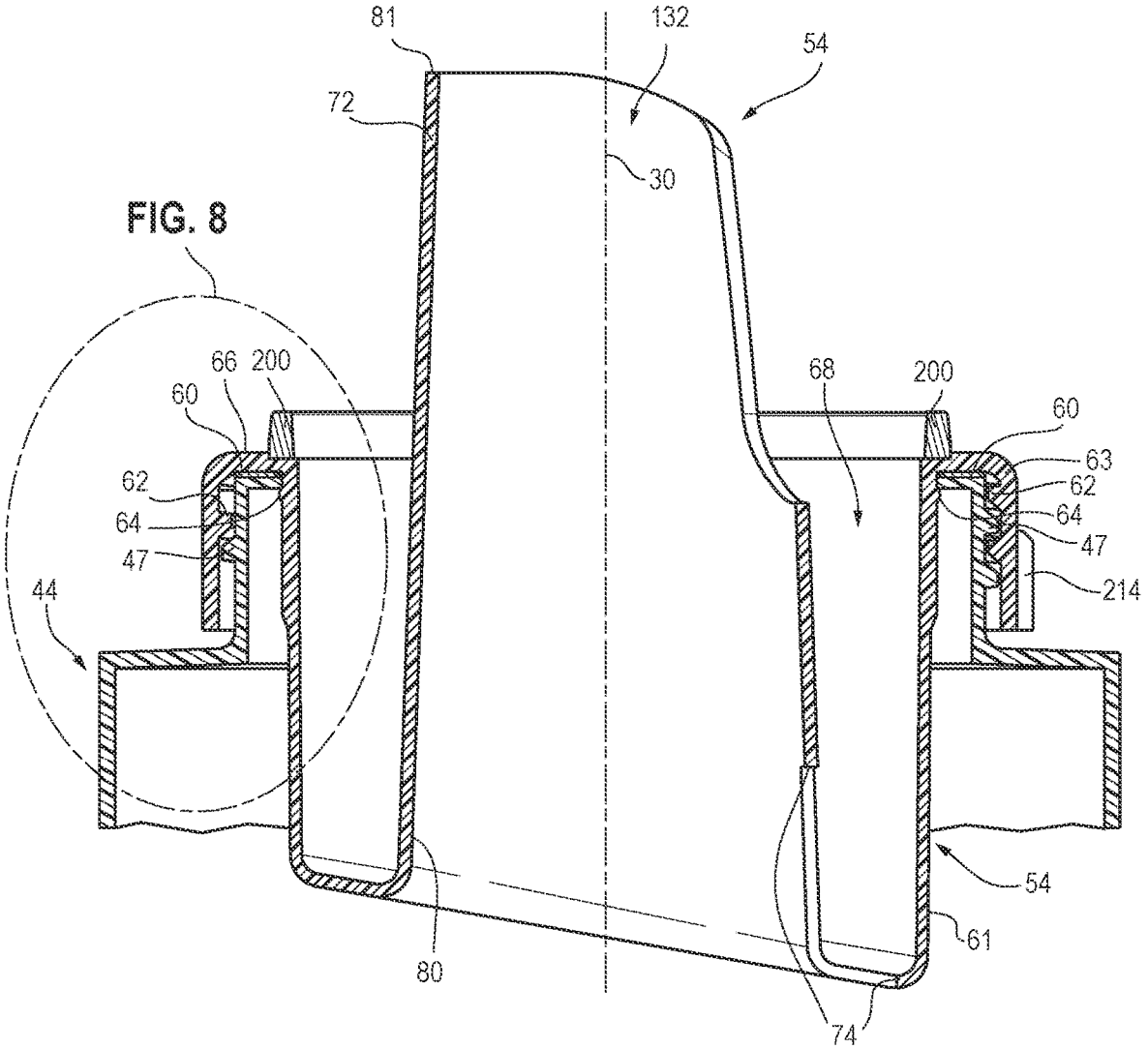
FIG. 7 is a cross-sectional view of the dispensing closure and container similar to that shown in FIG. 3, however

With reference now to FIG. 7, the closure body or body 54 includes a generally U-shaped or trough-like annular wall 61 for being located at and within the opening of a container 44. Laterally or radially surrounding the wall 61 is an annular skirt 63 provided with a female screw thread 62 for mating with the male thread 47 of the container 44 to secure the closure body 54 at the opening of the container 44. It will be appreciated that other conventional or special means of connecting the closure body 54 to the container 44 could be employed, such as mating snap-fit beads, bi-injection molding, adhesives, mechanical locks, spin welding of the closure to the container, etc.

Figure 8:
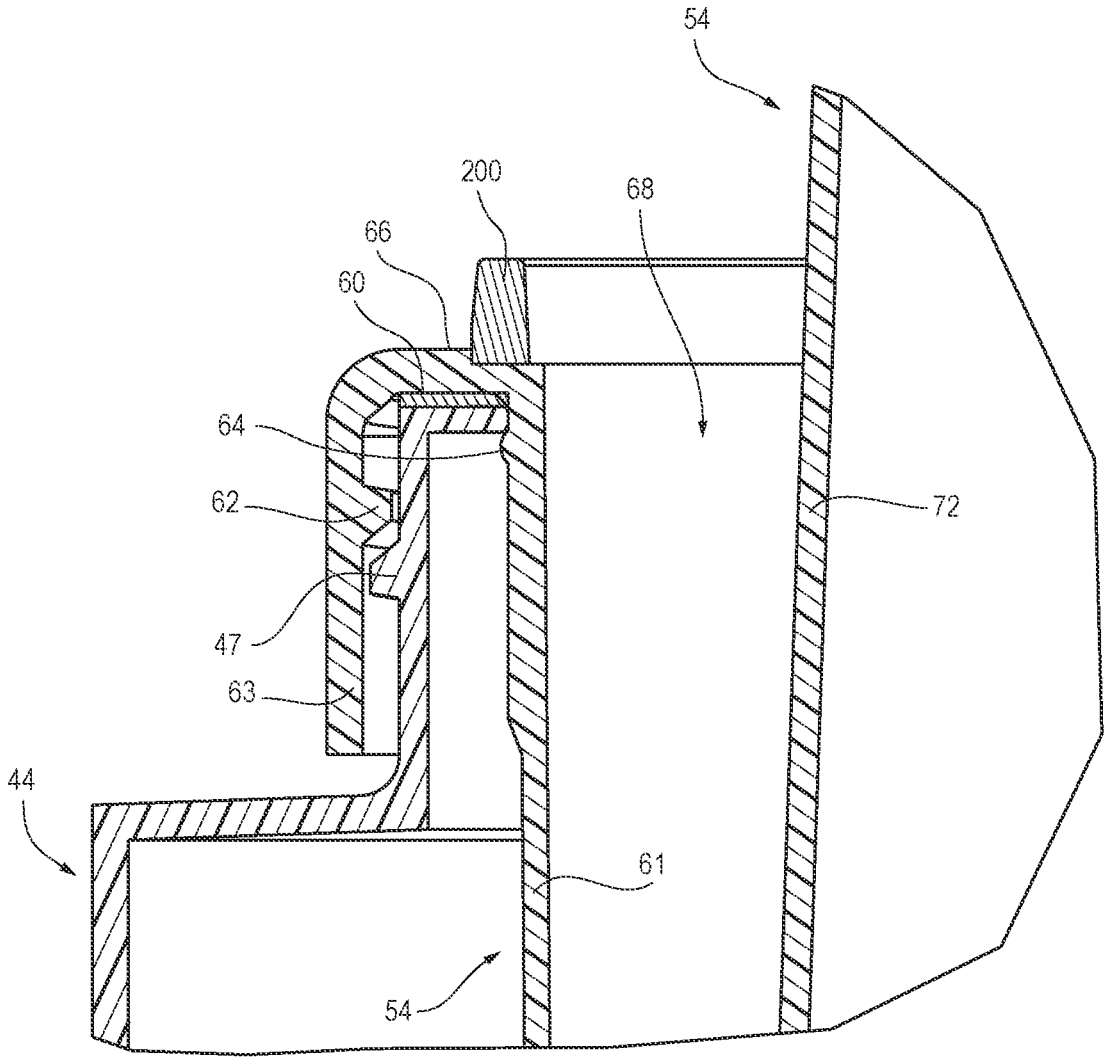
FIG. 8 is an enlarged, detailed cross-sectional view of the enclosed portion of the dispensing closure and container in FIG. 7 labeled as "FIG. 8"

Referring now to FIGS. 7 and 8, the wall 61 of the closure body 54 includes a liner retention projection or bead 64 that extends laterally outwardly therefrom. The liner retention projection 64 extends around the perimeter of the wall 61 and functions to retain a subassembly of the closure body 54 and the liner 60 together prior to installation with a container 44, which will be discussed in detail hereinafter. It will be understood that the liner retention projection 64 could have the form of a plurality of discrete, spaced-apart projections (not illustrated) in order to achieve the same function of retaining the liner 60 with the closure body 54 prior to installation upon a container 44. The closure body 54 further includes a generally flat top deck 66 for supporting a sealing means, which will be discussed in detail below.

Referring now to FIGS. 3 and 7, the wall 61 partly defines an annular recessed well or trough 68 together with a radially inward, upwardly-extending dispensing or pour spout 72. The recessed well 68 accommodates a portion of the closing element 56 when it is positioned atop the closure body 54 in a closed condition or position (as illustrated in FIGS. 1 and 3), A drain aperture 74 is provided at the bottom most portion of the recessed well 68 to permit residual fluent product on the pour spout 72, wall 61, and/or closing element 56 to drain back into the interior of the container 44. The pour spout 72 includes an internal or interior surface 80 to permit the flow of a fluent substance through the body 54, the pour spout 72 extending from the bottom of the recessed well 68 and terminating at a pour lip 81 at a location that is axially outwardly of the wall 61. A viewing port or cutout 82 (best seen in FIG. 5) is located on an opposite side of the pour spout 72 relative to the pour lip 81, which permits a user of the closure to view the dispensed contents as it flows through the closure body 54 during use. The interior surface 80 further defines a flow passage or through passage 132 for communicating with the container interior to permit the flow of a fluent substance through the closure body 54.

Figure 9:
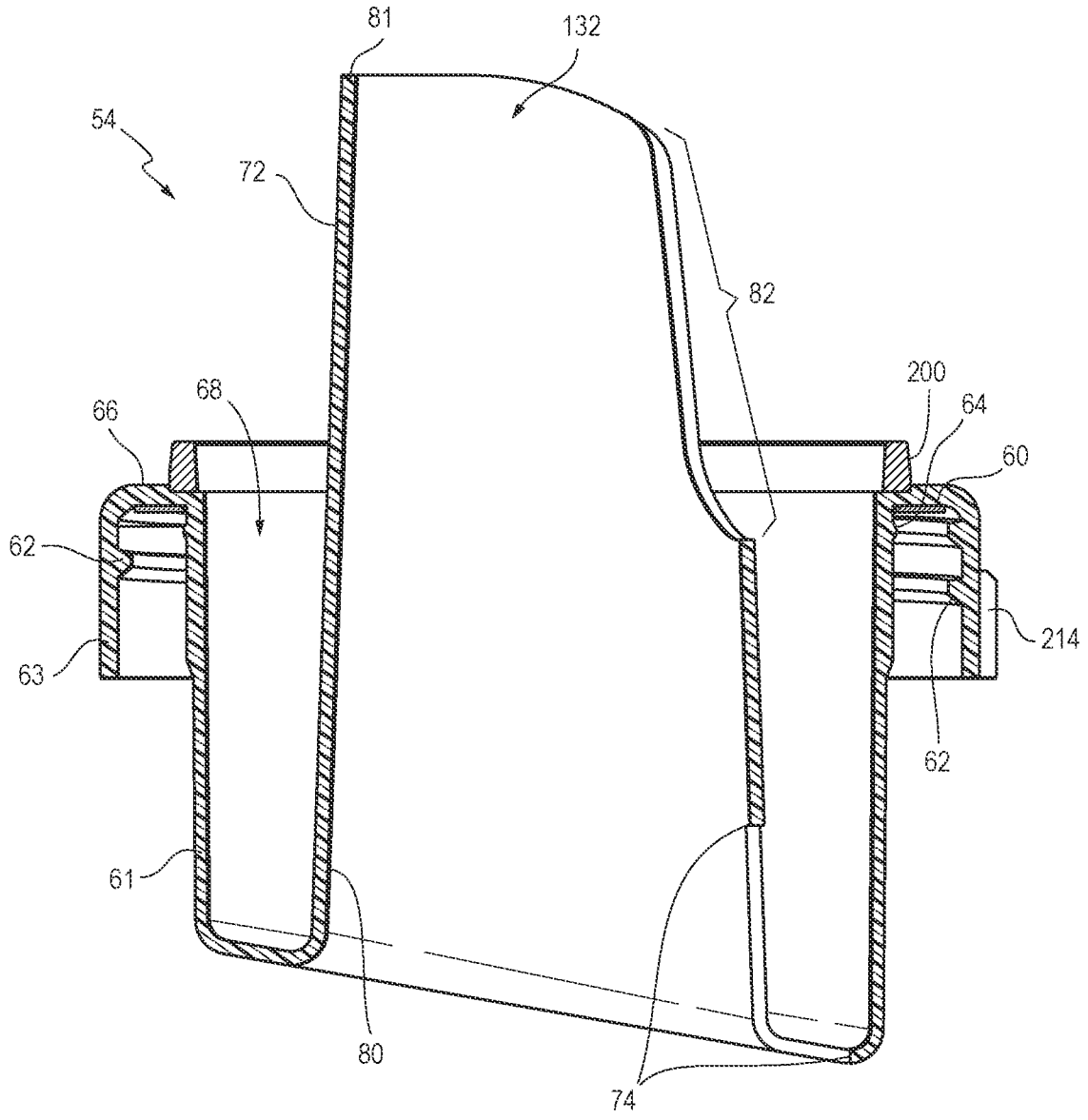
FIG. 9 is a cross-sectional view of the dispensing closure similar to that shown in FIG. 7, however

With reference to FIGS. 8 and 9, the closure body 54 is further provided with an annular sealing means or crushable seal 200 that extends upwardly from the top deck 66. The crushable seal 200 has a frustoconical shape that tapers in the axially upward direction away from the top deck 66 of the closure body 54, when viewed in a cross-sectional vertical plane extending through the central axis 30. As will be discussed below, the crushable seal 200 is configured to be engaged by a surface of the relatively more rigid closing element 56 such that the crushable seal 200 compresses downward and outward to effectively seal between the closure body 54 and the closing element 56 when the closing element 56 is located in a closed condition or position atop the closure body 54. The crushable seal 200 is molded or formed with the closure body 54, such as by bi-injection molding, from a suitable resilient, elastomeric material such as an injection moldable grade of thermoplastic elastomer ("TPE"). Other materials may be employed instead. In some applications, the crushable seal 200 could be adhered or friction fit to the closure body 54, and in still other applications the crushable seal 200 could be integrated into the closing element 56 instead of the closure base 54.

Figure 5:
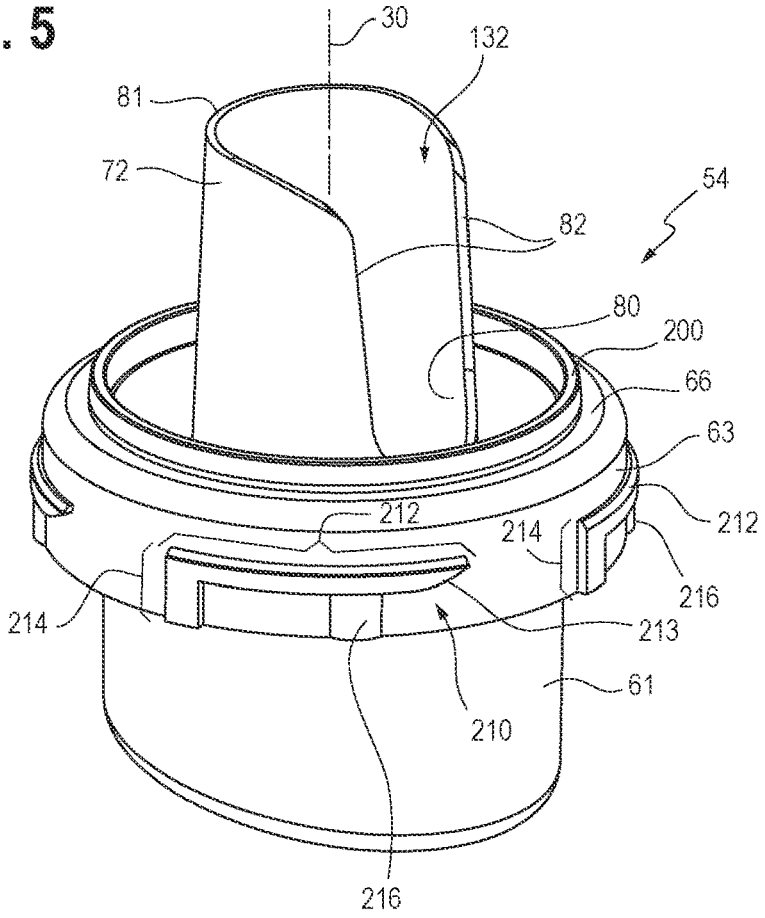
FIG. 5 is an isometric view, taken from above, of only the body of the dispensing closure illustrated in FIG. 1.
Figure 6:
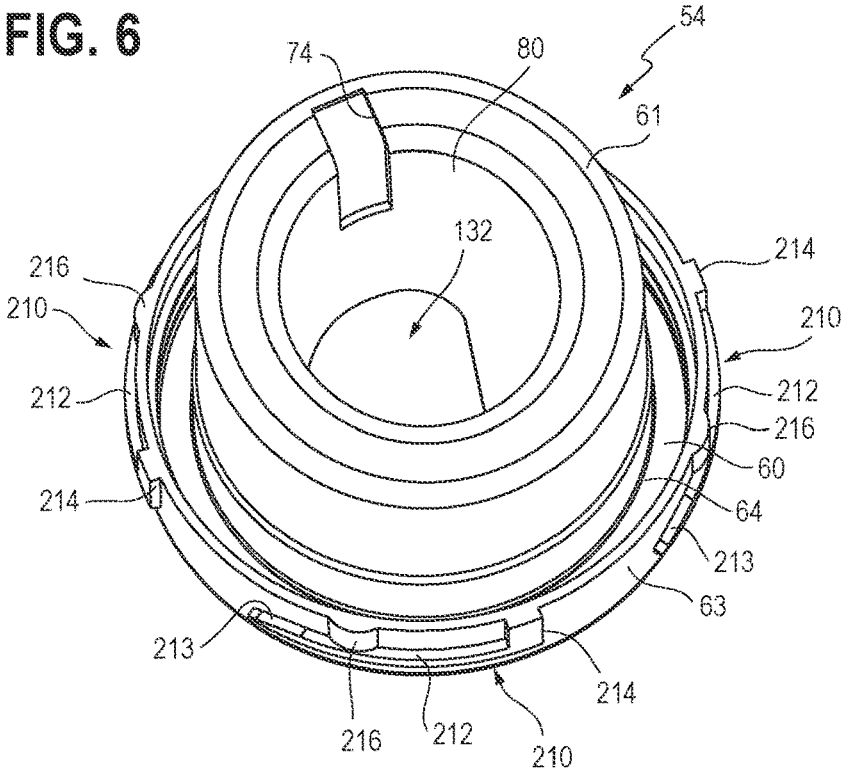
FIG. 6 is an isometric view, taken from below, of the body of the dispensing closure illustrated in FIG. 5.

With reference to FIGS. 5 and 6, the closure body 54 is provided with four closure body lateral projections 210 for accommodating four mating features on the closing element 56 to secure the closing element 56 in its closed condition atop the closure body 54. Each of the closure body lateral projections 210 includes a circumferentially-extending top portion 212 having an open first end 213 and a closed second end in the form of an axially-extending stop portion 214. The closure body lateral projections 210 further include an abutment or ramp 216 in between the open first end 213 and the stop portion 214. These structures effectively trap or retain the mating features of the closing element within an area between the ramp 216 and the stop portion 214 to prevent the closing element 56 from moving axially away from the closure body 54, thus maintaining the compression of the crushable seal 200 with the closing element 56 installed on the closure body 54. It will be understood that while the illustrated preferred embodiment of the closing element 56 includes four discrete projections 210, the closure body 54 could be provided with just one projection 210 or any number thereof.

It will be understood that while the closure body 54 is illustrated as having a generally cylindrical shape, the body 54 may take a variety of forms such that the outer wall 61 and/or the surrounding flange 63 may be square, elliptical, polygonal, or some other, irregular cross-sectional shape (in the plane extending normal to the central axis 30).

If the closure body 54 is to be used on a container 44 in the form of a flexible pouch (not illustrated), then it is presently contemplated that the closure body 54 end would have a suitable fitment configuration (e.g., such as that shown and described in U.S. Pat. No. 10,124,936, which is incorporated by reference herein in its entirety) for being sealed with such a pouch, and most pouch manufacturers will prefer to install the closure body 54 inlet end at an opening formed in the pouch with heat sealing techniques or ultrasonic sealing techniques.

Figure 10:
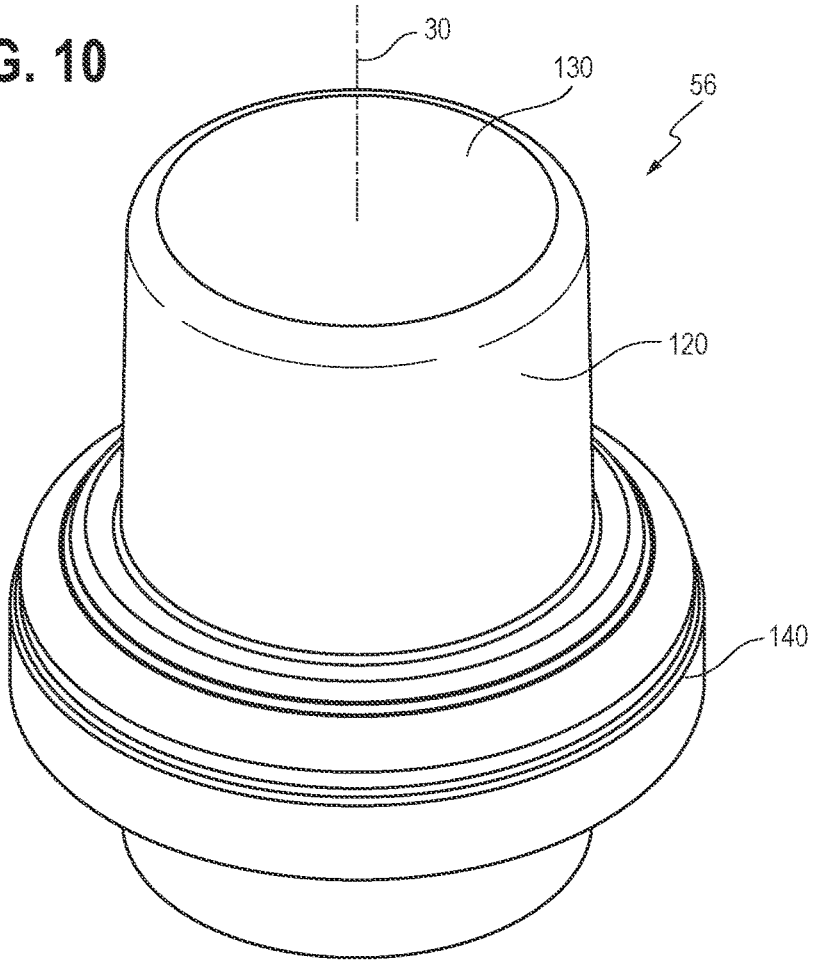
FIG. 10 is an isometric view, taken from above, of only the closing element of the dispensing closure of FIG. 1.
Figure 12:
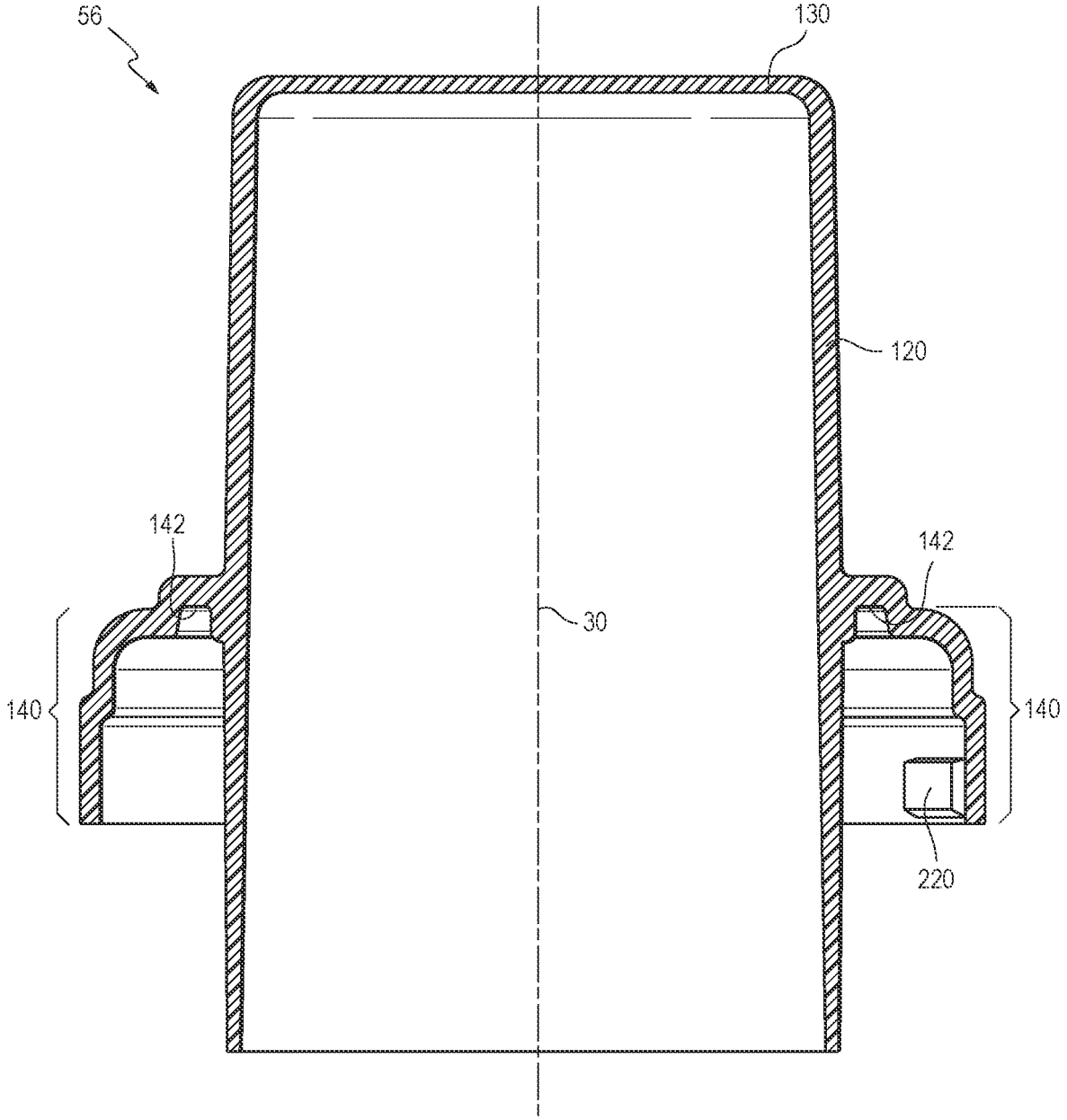
FIG. 12 is a cross-sectional view of the closing element illustrated in FIG. 10, taken generally along a vertical plane extending through a central axis defined by the closure.

With reference now to FIGS. 3, 10, and 12, the closing element 56 is generally cylindrical and has the form of a dosing or measuring cup. The closing element 56 includes an outer wall 120 connecting to a top end or wall 130 for being mounted around the pour spout 72 of the closure body 54 with the closing element 56 in a closed condition (as shown in FIG. 3). The closing element 56 further includes an outer flange 140 that is adapted to extend radially outwardly of the annular skirt 63 of the closure body 54 (FIG. 3). The outer flange 140 includes a substantially flat, annular sealing surface 142 for sealing against the flexible, crushable seal 200 of the closure body 54 in the closed condition of the closing element 56 (as shown in FIG. 3).

Figure 11:
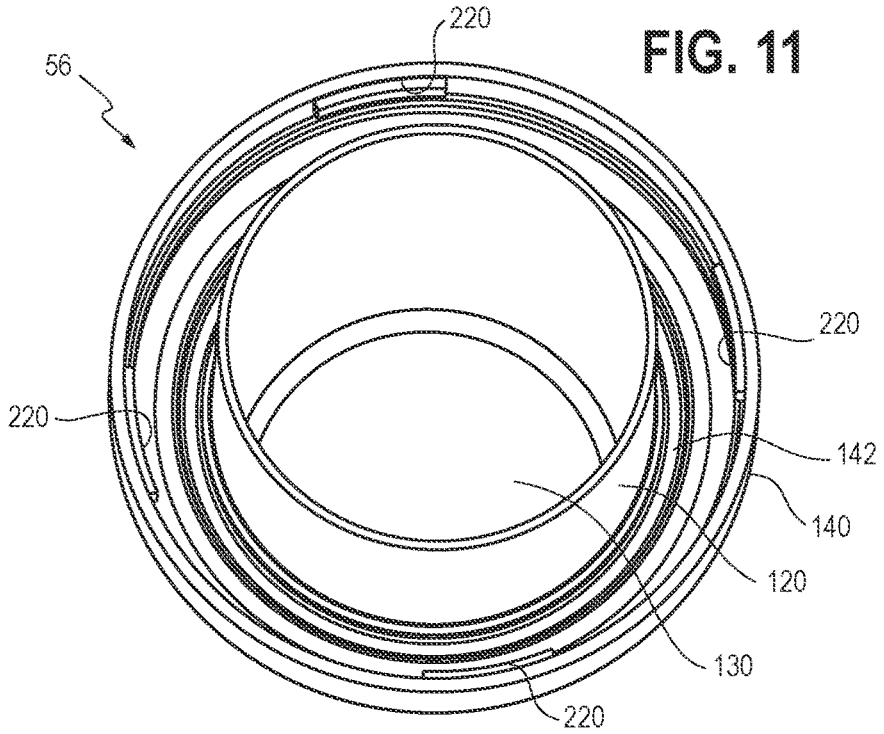
FIG. 11 is an isometric view, taken from below, of the closing element of the dispensing closure of FIG. 10.

Referring now to FIGS. 11 and 12, the flange 140 of the closing element 56 includes four laterally or radially-inwardly extending, trapezoidal projections 220 (only one of which is visible in FIG. 12). As will be discussed below with respect to the operation of the closure 40, each one of the projections 220 of the closing element 56 cooperates with one of the closure body lateral projections 210 to effectively trap or retain the projections 220 within an area between the ramp 216 and the stop portion 214 of the closure body lateral projections 210 to prevent the closing element 56 from moving an appreciable distance axially away from the closure body 54, thus maintaining the compression of the crushable seal 200 with the closing element 56 installed on the closure body 54.

The inventors have found that the closure 40 may be advantageous as compared to prior art closures to provide a substantially leak-free seal between a container and the closure 40 and a substantially leak-free seal between the closure body 54 and the closing element 56 in the form of a removable measuring cup, and all of such seals may exhibit more robustness to typical forces, heat, hydraulic hammer, and pressures experienced by a package containing the closure 40 and the bottle during shipping and handling of the package, particularly in e-commerce distribution chains. The sealing and retaining means between the closure body 54 and the closing element 56 enables the seal between these structures to be maintained even if the closing element 56 rotates or twists slightly during transit. In addition, the closing element 56 may be removed by simple rotation relative to the body 54, and no special or complex action is required by the user of the closure 40.

In a typical method of assembling and installing the closure 40 on a container 44 of a fluent substance to create a package, the closure body 54 would first be assembled with the liner 60 as a subassembly. With reference to FIGS. 6 and 9, the ring-shaped liner 60 may be axially pressed between the wall 61 and the retention projection 64 to loosely retain the liner 60 in a space beneath the top deck 66 for subsequent installation with a container 44 (as shown in FIG. 8). The closure body 54 and liner 60 subassembly and the closing element 56 may be shipped to a bottler (filler) which installs the subassembly of the closure body 54 and liner 60 on the container 44 by screw threading the closure body 54 atop the opening of the container 44 to engage the threads 62 of the closure body 54 with the threads 47 of the container 44.

With reference to FIG. 7, with the liner 60 disposed between the top end of the container 44 and the underside of the closure body top deck 66, a heat seal (i.e., a thermal bond) is created by induction (RF) heating to bond the lower side of the liner 60 to the container 44 and the upper, opposite side of the liner 60 to the underside of the closure body top deck 66. In one presently preferred method of installation, the bonds between the liner 60 to both the container 44 and the closure body 54 is sufficiently strong such that the torque required to initially effect relative rotation between the closure body 54 and the container 44 for destroying the heat-sealed installation and permit removal of the closure 40 is greater than what a typical user can exert on the closure 40 and container 44.

The container 44 may be filled with contents or fluent product prior to the installation of the closure 40 onto the container 44, or after closure 40 installation by filling the container 44 through the closure passage 132 with a suitable nozzle or cannula.

With reference to FIGS. 1, 3, 5 and 12, the closing element 56 may then be axially installed over the closure body 54 once the container 44 has been filled. The closing element 56 is brought axially toward the closure body 54 and rotated clockwise about the central axis 30 until the four lateral projections 220 of the closing element 56 contact the open first ends 213 and are guided along the circumferentially-extending top portions 212, then moving against and overtop (radially outwardly of) the ramps 216 into the area between the ramps 216 and the stop portions 214. As the closing element 56 is brought into contact with the closure body 54, the annular sealing surface 142 contacts and compresses the crushable seal 200 axially inwardly toward the top deck 66 and the crushable seal 200 may expand radially outwardly. The inventors have found that the engagement of the lateral projections 220 of the closing element 56 and the stop portions 214 of the closure body 54 provides the transfer of torque from the closing element 56 to the closure body 54 during the capping process. This permits an assembly of the closing element 56, the closure body 54, and the liner 60 to be applied in one capping operation after the container 44 has been filled, thereby simplifying the capping process for the filler.

Typically, a closure manufacturer would make or provide several of the package components (e.g., the closure body 54, the liner 60, and the closing element 56—but usually not the container 44), then assemble some or all of those components, and then ship the assembly or components to a bottler for installation on a filled container 44.

Alternatively, depending on the manufacturing capability of the bottler, some of the steps of assembling the closure 40 components could be performed by the bottler instead of the closure manufacturer. For example, the closure body 54, the liner 60, and the closing element 56 may be shipped by the closure manufacturer to a bottler as separate, unassembled components, and then the bottler can assemble the closure components, fill the container, and subsequently install the assembled closure components on the container 44.

The detailed operation and function of the dispensing closure 40 will next be described with initial reference to FIGS. 1 and 3. Typically, a user, such as a customer, will encounter the closure 40 as shown in FIGS. 1 and 3, with the closure 40 installed upon the top end at the opening of a container 44 of a fluent substance—the closure 40, container 44, and fluent substance within the container together defining a package.

Figure 4:
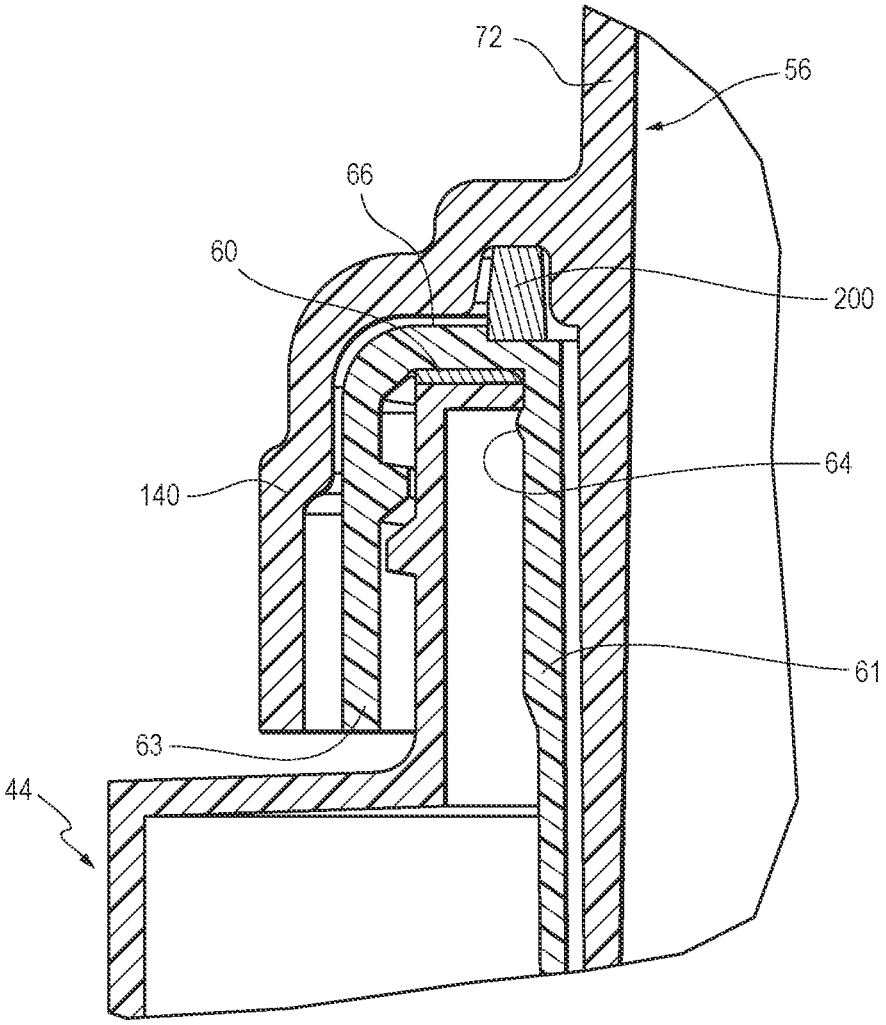
FIG. 4 is an enlarged, detailed cross-sectional view of the enclosed portion of the dispensing closure and container in FIG. 3 labeled as "FIG. 4"

The closure 40 is presented to a user in its non-dispensing, closed condition with the closing element 56 oriented around the pour spout 72 of the closure body 54. With reference to FIGS. 3 and 4, in the closed condition the closing element 56 is in sealing contact with the closure body 54 such that the annular sealing surface 142 contacts and compresses the crushable seal 200 axially inwardly toward the more rigid top deck 66. The user may then grip the outer wall 120 (FIG. 3) of the closing element 56 to begin to rotate it counterclockwise relative to the closure body 54 to begin to open the closure 40. With reference to FIGS. 5 and 12, as the closing element 56 is rotated counterclockwise about the central axis 30, the four lateral projections 220 (FIG. 12) of the closing element 56 contact and move away from the stop portions 214 (FIG. 5) and overtop of (radially outwardly of) the ramps 216 (FIG. 5). Further rotation of the closing element 56 moves the four lateral projections 220 past the open ends 213 (FIG. 5) until the lateral projections 220 are clear of the closure body lateral projections 210 (FIG. 5) such that the closing element 56 may be lifted axially outwardly (along the axis 30) and completely separated from the closure body 54 to expose the pour spout 72.

With reference to FIG. 7, the user can begin to dispense the fluent substance from the container 44 through the closure body 54 by tipping or inverting the container 44 and closure body 54 sufficiently such that the force of gravity on the fluent substance in the container 44 carries the fluent substance from the container interior, through the passage 132 to the pour lip 81, and down to a target dispensing location such as the closing element 56, cup or other receptacle.

When the user ceases to tip or invert the container 44 and the closure body 54, the closing element 56 may then be reinstalled over the closure body 54. As described above, the closing element 56 is brought axially toward the closure body 54 and rotated clockwise about the central axis 30 until the four lateral projections 220 of the closing element 56 contact the open first ends 213 and are guided along the circumferentially-extending top portions 212, then moving against and overtop (radially outwardly of) the ramps 216 into the area between the ramps 216 and the stop portions 214. As the closing element 56 is brought into contact with the closure body 54, the annular sealing surface 142 contacts and compresses the crushable seal 200 axially inwardly toward the top deck 66 and the crushable seal 200 may expand radially outwardly.

The inventors have found that the closure 40 is especially suitable for viscous fluent substances having a viscosity between about 40 mPa·s and about 600 mPa·s, such as liquid laundry detergent. In addition, the inventors have found that the dispensing closure 40 described herein may be mass produced for less cost compared to current taps and dispensing closures that have additional complex components such as valves and metal springs etc., and the closure 40 may be more easily actuated or operated by the user, and yet is still readily resistant to accidental opening.

While a closure could be provided with a standard helical threaded attachment between the closure body and the closing element employing an integrally molded flat seal, the inventors have found that such a closure would be prone to leaking if there is appreciable unthreading of the closing element relative to the closure body during shipping as a result of vertical movement allowed by the helical thread.

Furthermore, the closure could be provided with a conventional removable liner inserted between the container and the closure during package filling and capping, to prevent leakage during shipping. However, the inventors have found that such a liner requires that for a user to access the product, the consumer needs to unthread the closure from the bottle, remove the liner, and then reattach the closure. Additionally, a shrink wrap seal may be applied over the closure assembly to keep the closing element on the container. The inventors have found that this solution may keep the closing element and the closure body together during shipping, but this solution may not adequately secure the closure body to the container.

The inventors have considered utilizing ratcheting "locks" which may be incorporated into the container and closure body designs to retain these structures, locking the closure body to the container. Execution of this attachment system depends on the accuracy of a blow molded container or bottle, which generally has more variance than injection molded parts and may require a very specific container neck design to engage the ratchets on the closure body. Further, the closure body could be glued to the bottle and a helical threaded closing element. The use of glue makes for a challenging package capping line system and the helical threaded closing element can be dislodged by typical shipping impacts.

A second embodiment of a dispensing closure according to the present invention (or components thereof) is illustrated in FIGS. 13-16 and is designated generally by the numeral 40A. The numbered features of the second embodiment of the closure 40A illustrated in FIGS. 13-16 are analogous to features of the first embodiment of the closure 40 of FIGS. 1-12 that share the same number (but without the suffix "A"). The second embodiment of the closure 40A includes the basic components of a hollow closure base or body 54A (best seen in FIG. 13) for being located at the opening of a container 44A (visible in FIG. 15), and a cap or closing element 56A (visible in FIG. 15) removably or releasably connected to the body 54A.

Figure 13:
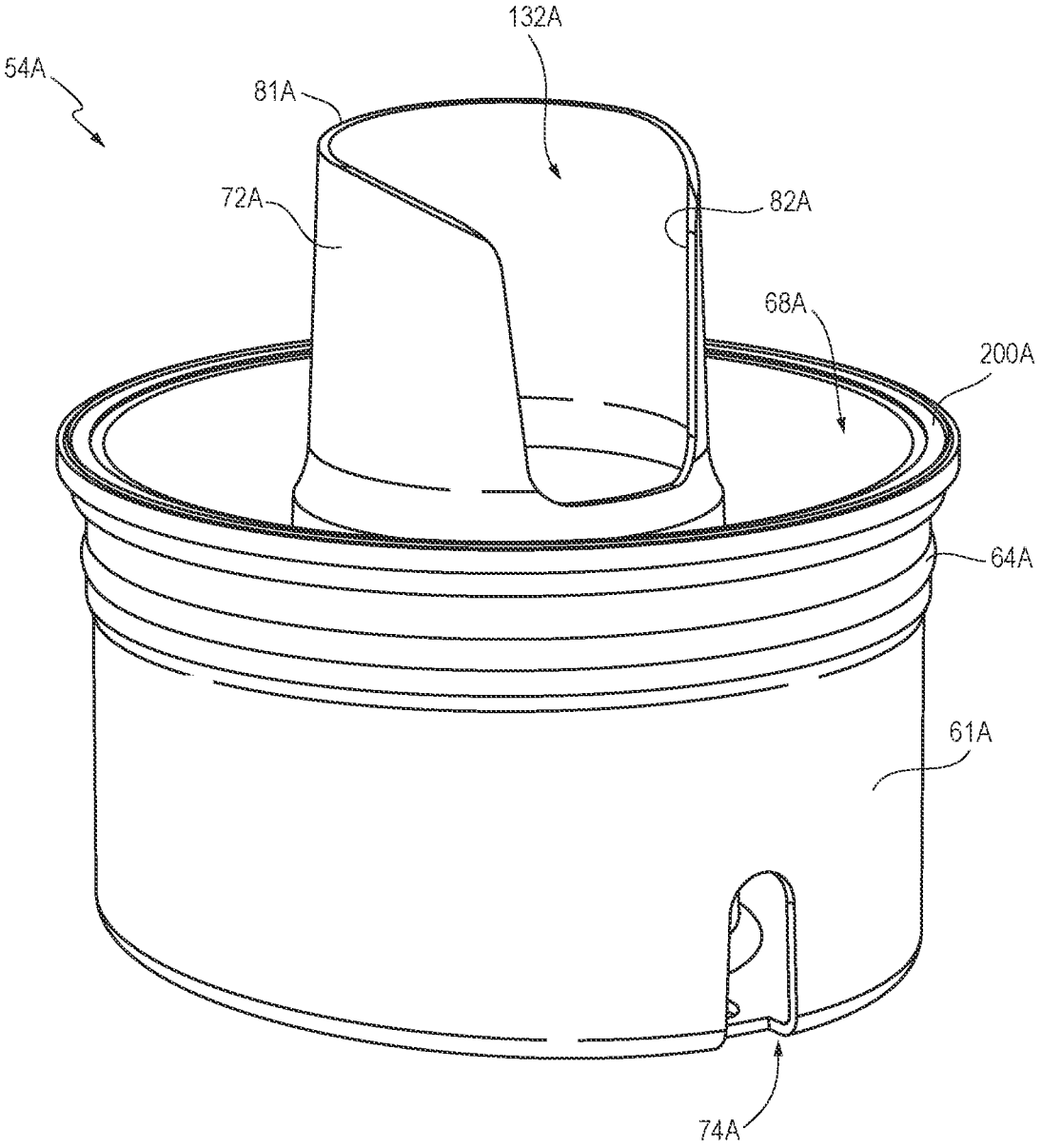
FIG. 13 is an isometric view, taken from above, of only a closure body of a second illustrated embodiment of a dispensing closure of the present invention.
Figure 14:
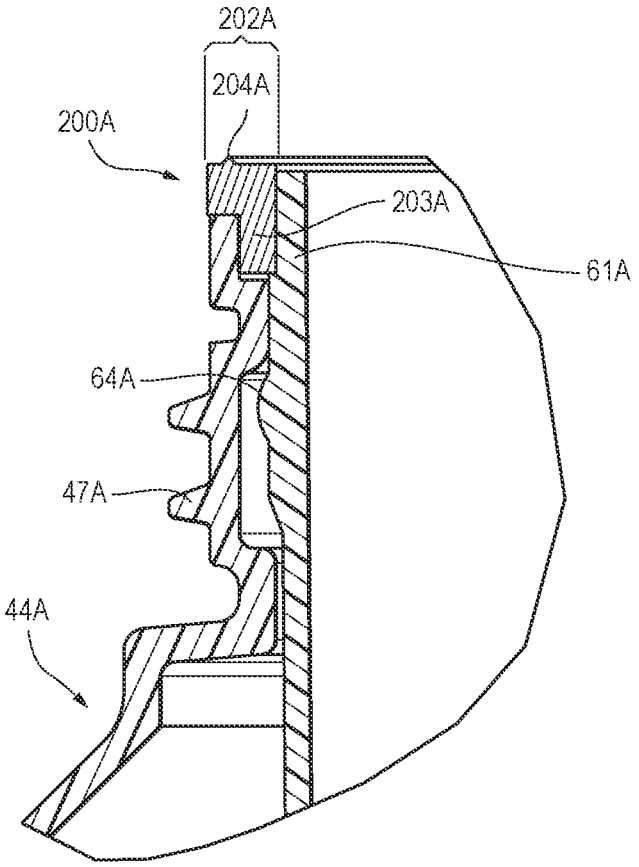
FIG. 14 is a greatly enlarged, cross-sectional view of a portion of the closure body of FIG. 13 installed at the opening of a container, taken generally along a vertical plane extending through and containing a central axis defined by the closure.

With reference to FIGS. 13 and 14, the closure body 54A of the second embodiment of the closure 40A differs from the closure body 54 of the first embodiment of the closure 40 in that the second embodiment of the closure 40A includes a modified means for sealingly engaging the opening of the container 44A. The closure body 54A includes a cylindrical wall 61A with a radially-extending retention bead or projection 64A for being engaged by a radially-inwardly extending flange of the container 44A. In addition, the closure body 54A includes an annular, crushable seal 200A formed at the top end of the wall 61A for engaging a top end of the bottle 44A. The crushable seal 200A has a somewhat L-shaped cross-section when viewed in a vertical plane extending through and containing the central axis 30A in FIG. 15, with a radially-outwardly extending upper portion 202A and a radially-outwardly extending lower portion 203A. The upper portion 202A of the seal 200A extends further in the radial direction, relative to the central axis 30A, than the lower portion 203A. The lower portion 203A is for being received within the opening of the container 44A, while the upper portion 202A is for sealingly engaging the top end of the container 44A when the closure body 54A is installed at the container opening.

Still referring to FIG. 14, the crushable seal 200A includes a triangular projection 204A that extends axially upwardly from the upper portion 202A of the seal 200A. As will be discussed in detail hereinafter, the upper portion 202A of the seal 200A is configured to be engaged and compressed when in sealing contact with a portion of the closing element 56A. The crushable seal 200A is molded or formed with the closure body 54A, such as by bi-injection molding, from a suitable resilient, elastomeric material such as an injection moldable grade of thermoplastic elastomer ("TPE"). Other materials may be employed instead. In some applications, the crushable seal 200A could be adhered, welded, friction fit to the closure body 54A, and in still other applications (not illustrated) the crushable seal 200A could be integrated into the closing element 56A instead of the closure base 54A.

Figure 15:
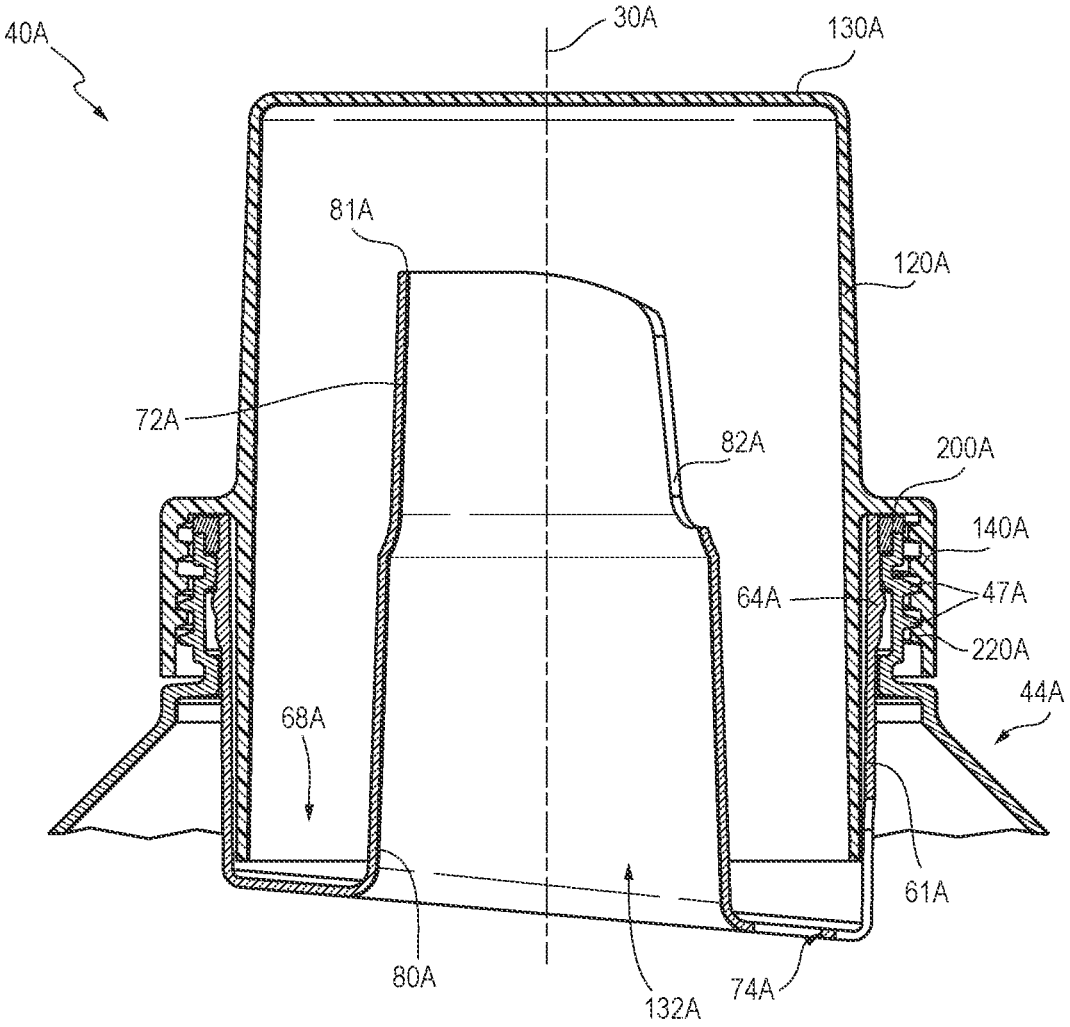
FIG. 15 is a cross-sectional view of the closure body of FIG. 13 installed at the opening of a container and assembled with a closing element, taken generally along a vertical plane extending through and containing a central axis defined by the closure.

Referring now to FIG. 15, the closing element 56A includes an outer wall 120A connecting to a top end or cover 130A for being mounted around the pour spout 72A of the closure body 54A with the closing element 56A in a closed condition (as shown in FIG. 15). The closing element 56A further includes an outer flange 140A that is adapted to extend radially outwardly of the top end of the container 44A. The outer flange 140A includes a substantially flat, annular sealing surface 142A for sealing against the flexible, crushable seal 200A of the closure body 54A in the closed condition of the closing element 56A (as best seen in FIG. 16).

Figure 16:
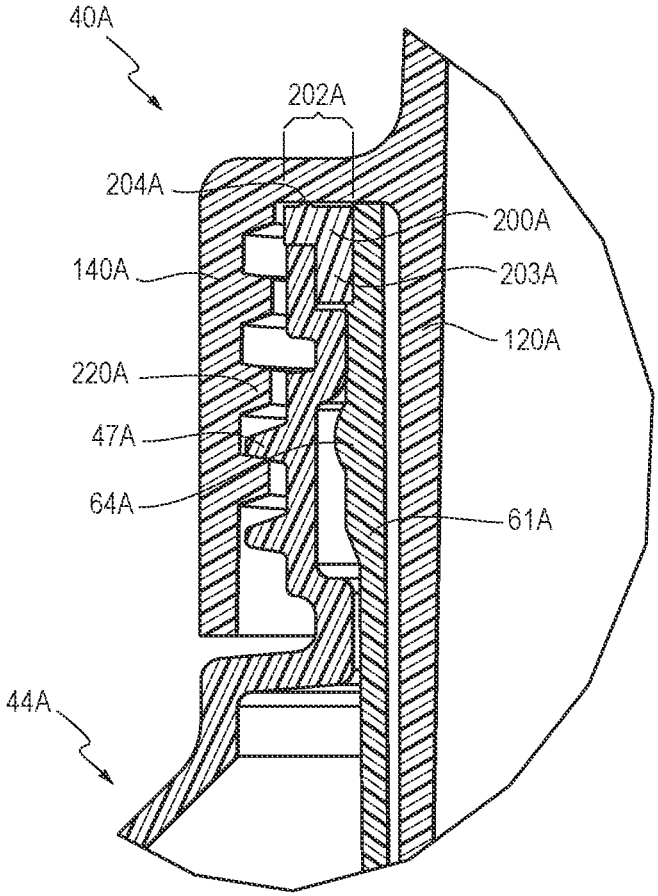
FIG. 16 is a greatly enlarged, cross-sectional view of a portion of the closure body, the closing element, and the container of FIG. 15, taken generally along a vertical plane extending through a central axis defined by the closure.

Referring now to FIG. 16, the flange 140A of the closing element 56A includes an internal, female screw thread 220A for mating with the male screw threads 47A on the top end of the container 44A to prevent the closing element 56A from moving an appreciable distance axially away from the closure body 54A, thus maintaining the compression of the crushable seal 200A with the closing element 56A installed on the closure body 54A.

The inventors have found that the closure 40A may be advantageous as compared to prior art closures to provide a substantially leak-free seal between a container and the closure 40A and a substantially leak-free seal between the closure body 54A and the closing element 56A in the form of a removable measuring cup, and all of such seals may exhibit robustness to typical forces, heat, hydraulic hammer, and pressures experienced by a package containing the closure 40A and the bottle during shipping and handling of the package, particularly in e-commerce distribution chains. The sealing and retaining means between the closure body 54A and the container 44A eliminates the need for additional components such as a foil liner. In addition, the closing element 56A may be removed by simple rotation relative to the body 54A, and no special or complex action is required by the user of the closure 40A.

A third embodiment of a dispensing closure according to the present invention (or components thereof) is illustrated in FIGS. 17-21 and is designated generally by the numeral 403. The numbered features of the third embodiment of the closure 403 illustrated in FIGS. 17-21 are analogous to features of the first embodiment of the closure 40 of FIGS. 1-12 that share the same number (but without the suffix "B"). The third embodiment of the closure 40B includes the basic components of a hollow closure base or body 54B (best seen in FIG. 17) for being located at the opening of a container 44B (visible in FIG. 18), a cap or closing element 56B (visible in FIG. 20) removably or releasably connected to the body 54B, and a metallic or composite liner 60B (visible in FIG. 19) for being heat sealed between the container 44B and the closure body 54B.

Figure 17:
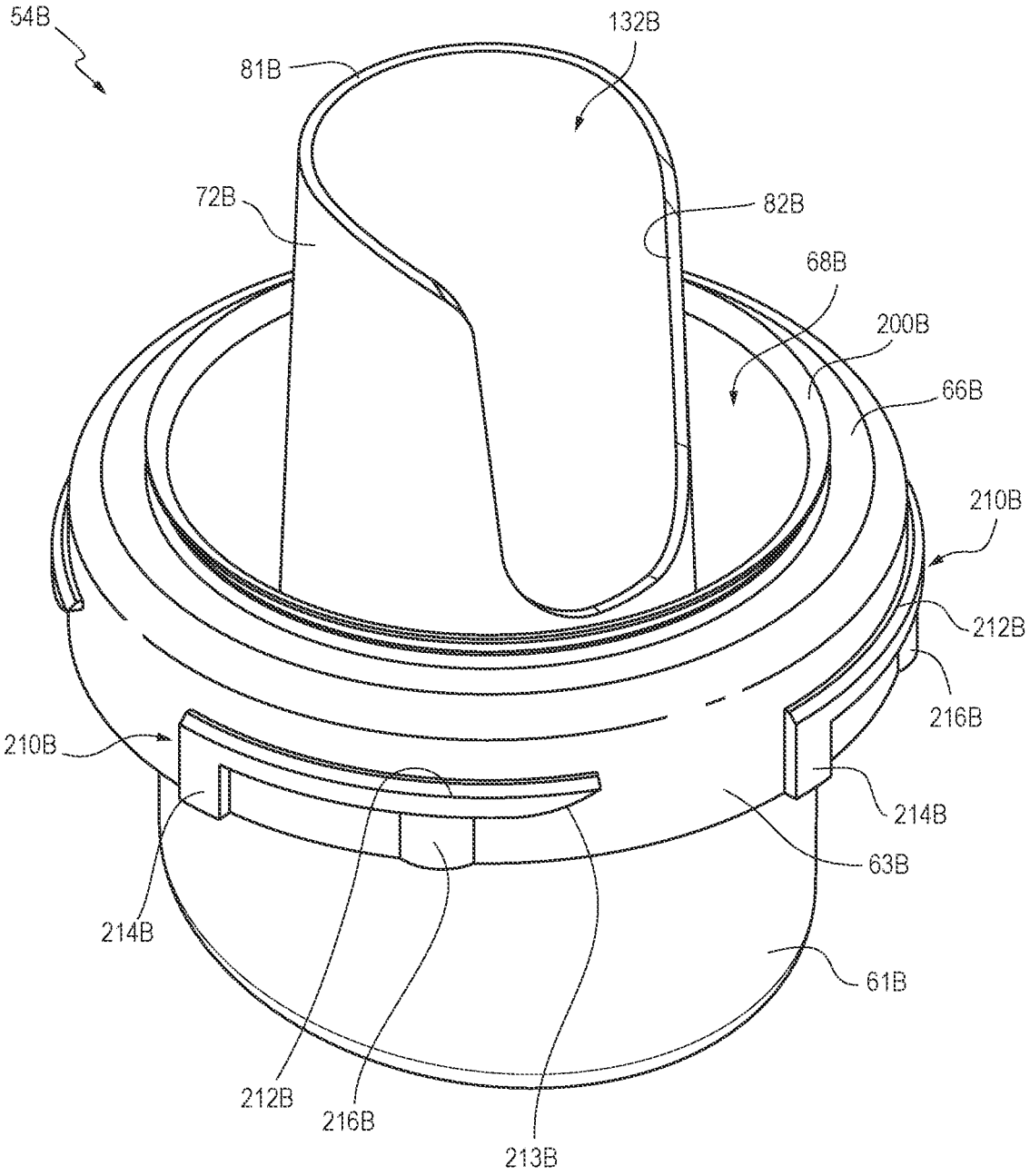
FIG. 17 is an isometric view, taken from above, of only a closure body of a third illustrated embodiment of a dispensing closure of the present invention.
Figure 20:
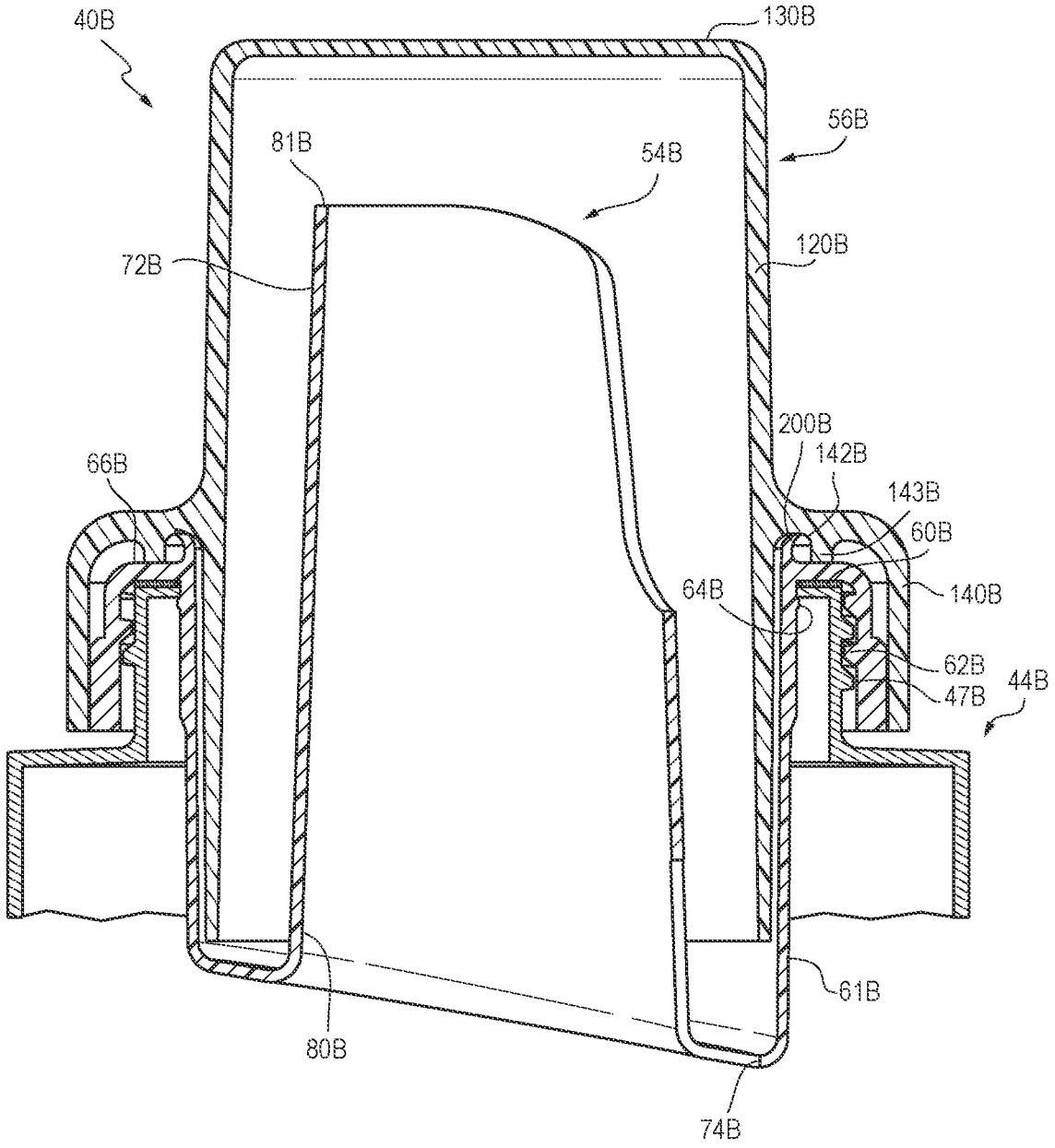
FIG. 20 is a cross-sectional view of the closure body, the liner, and the container of FIG. 18 assembled with a closing element, taken generally along a vertical plane extending through a central axis defined by the closure.

With reference to FIG. 17, the closure body 543 of the third illustrated embodiment of the closure 40B is similar to the first illustrated embodiment of the closure 40 in that the body 54B includes lateral projections 2103 for accommodating four mating features on the closing element 56B to secure the closing element 56B in its closed condition or orientation atop the closure body 543 (as seen in FIG. 20). Each of the closure body lateral projections 210B includes a circumferentially extending top portion 212B having an open first end 213B and a closed second end in the form of an axially extending stop portion 2143. The closure body lateral projections 210B further include an abutment or ramp 216B in between the open first end 213B and the stop portion 2143. These retaining means or structures effectively trap or retain the mating features of the closing element 56B within an area between the ramp 2168 and the stop portion 214B to prevent the closing element 56B from moving axially away from the closure body 548, thus maintaining the compression of a crushable seal 200B with the closing element 568 installed on the closure body 54B.

Figure 18:
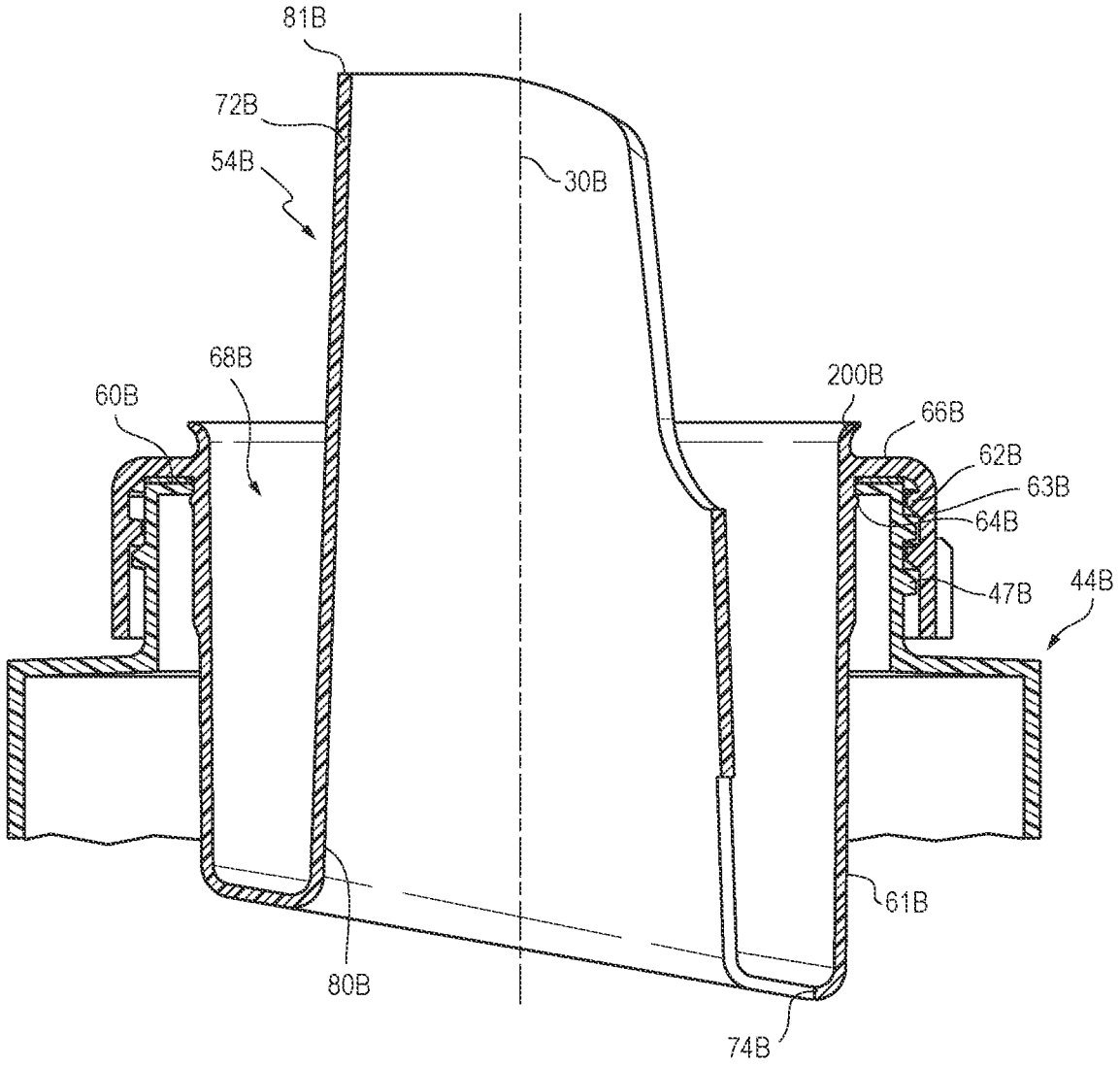
FIG. 18 is a cross-sectional view of the closure body of FIG. 17 installed with a liner at the opening of a container, taken generally along a vertical plane extending through a central axis defined by the closure.
Figure 19:
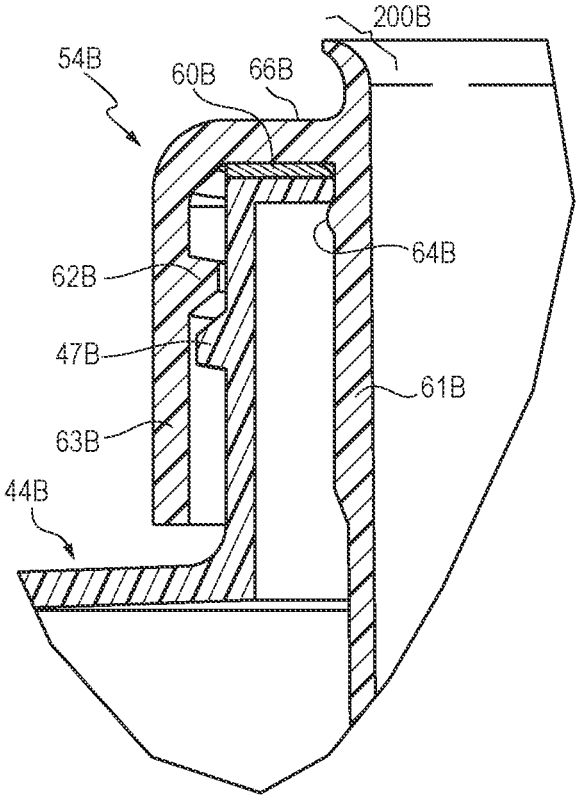
FIG. 19 is a greatly enlarged, cross-sectional view of a portion of the closure body, the liner, and the container of FIG. 18, taken generally along a vertical plane extending through a central axis defined by the closure.

With reference to FIGS. 18 and 19, the closure body 54B of the third embodiment of the closure 40B differs from the closure body 54 of the first embodiment of the closure 40 in that the third embodiment of the closure 40B includes a modified means for sealingly engaging the closure body 54B and the closing element 56B. Specifically, the closure body 548 includes a crushable seal 200B in the form of tapering, arcuate extension projecting radially and axially outwardly from the wall 61B over the top deck 668 of the closure body 54B. The seal 2008 defines a radially outwardly facing concave surface and a radially inwardly facing convex surface, as best viewed in FIG. 19. The crushable seal 200B is preferably molded or formed unitarily, from the same material, with the remainder of the closure body 548 and is sufficiently resilient to elastically deflect or crush when engaged by the closing element 56B. In some applications, the crushable seal 2008 could be separately molded, adhered, welded, friction fit to the closure body 54B.

Figure 21:
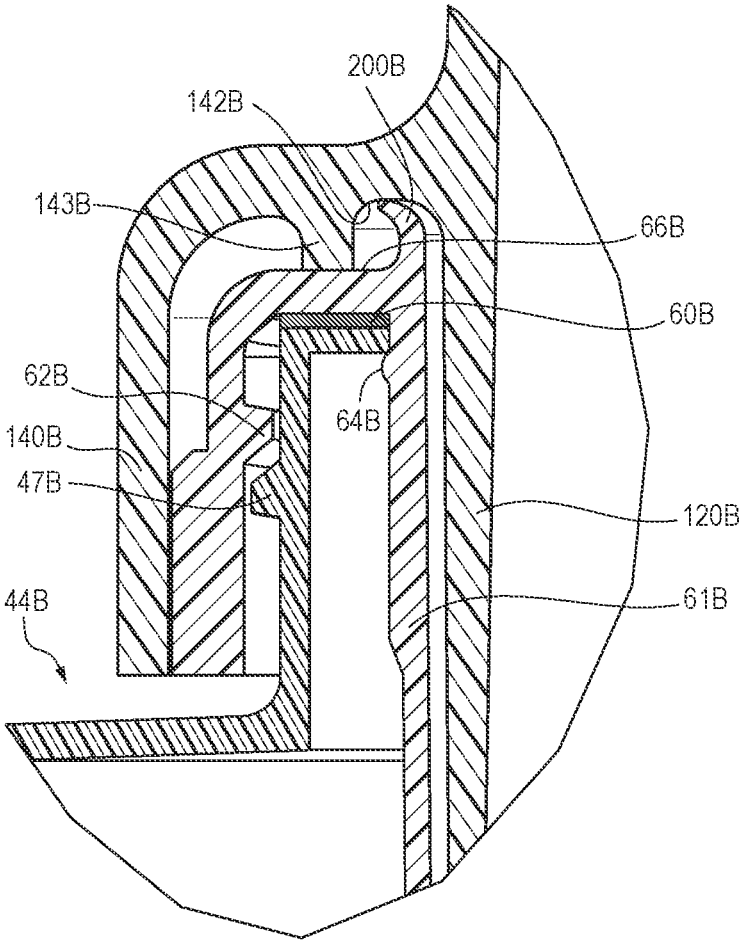
FIG. 21 is a greatly enlarged, cross-sectional view of a portion of the closure body, the liner, the closing element, and the container of FIG. 20, taken generally along a vertical plane extending through a central axis defined by the closure.

As can be seen in FIG. 21, the closing element 56B includes an outer wall 120B and an outer flange 140B that is adapted to extend radially outwardly of the top end of the container 44B and the closure body 548. The outer flange 1408 includes a concave, annular sealing surface 142B for sealing against the flexible, crushable seal 200B of the closure body 54B in the closed condition of the closing element 56B (as best seen in FIGS. 20 and 21). An abutment or projection 143B extends downwardly from the flange 140B to function as both a seal and a stop to prevent over compression or deflection of the seal 200B when the closing element 56B is brought into axial engagement with the closure body 54B. The closing element 56B includes four radially-inwardly extending projections to engage with the closure body projections 210B in the same manner to secure the closing element 56 with the closure body 54 in the first illustrated embodiment of the closure 40, as discussed above.

The closure 40B may be particularly advantageous as compared to prior art closures to provide a substantially leak-free seal between a container and the closure 40B and a substantially leak-free seal between the closure body 54B and the closing element 56B in the form of a removable measuring cup, and all of such seals may exhibit robustness to typical forces, heat, hydraulic hammer, and pressures experienced by a package containing the closure 40B and the bottle during shipping and handling of the package, particularly in e-commerce distribution chains. The formation of the seal 200B as a unitary extension of the closure body 54B may further reduce cost and manufacturing complexity when compared to other closures of the prior art. In addition, the closing element 56B may be removed by simple rotation relative to the body 54B, and no special or complex action is required by the user of the closure 40B.

A fourth embodiment of a dispensing closure according to the present invention (or components thereof) is illustrated in FIGS. 22-25 and is designated generally by the numeral 40C. The numbered features of the fourth embodiment of the closure 40C illustrated in FIGS. 22-25 are analogous to features of the first embodiment of the closure 40 of FIGS. 1-12 that share the same number (but without the suffix "C"). The fourth embodiment of the closure 40C includes the basic components of a hollow closure base or body 54C (best seen in FIG. 22) for being located at the opening of a container 44C (visible in FIG. 24), a cap or closing element 56C (best seen in FIG. 23) removably or releasably connected to the body 54C, and a metallic liner 60C (visible in FIG. 24) for being heat sealed or welded between the container 44C and the closure body 54C.

Figure 22:
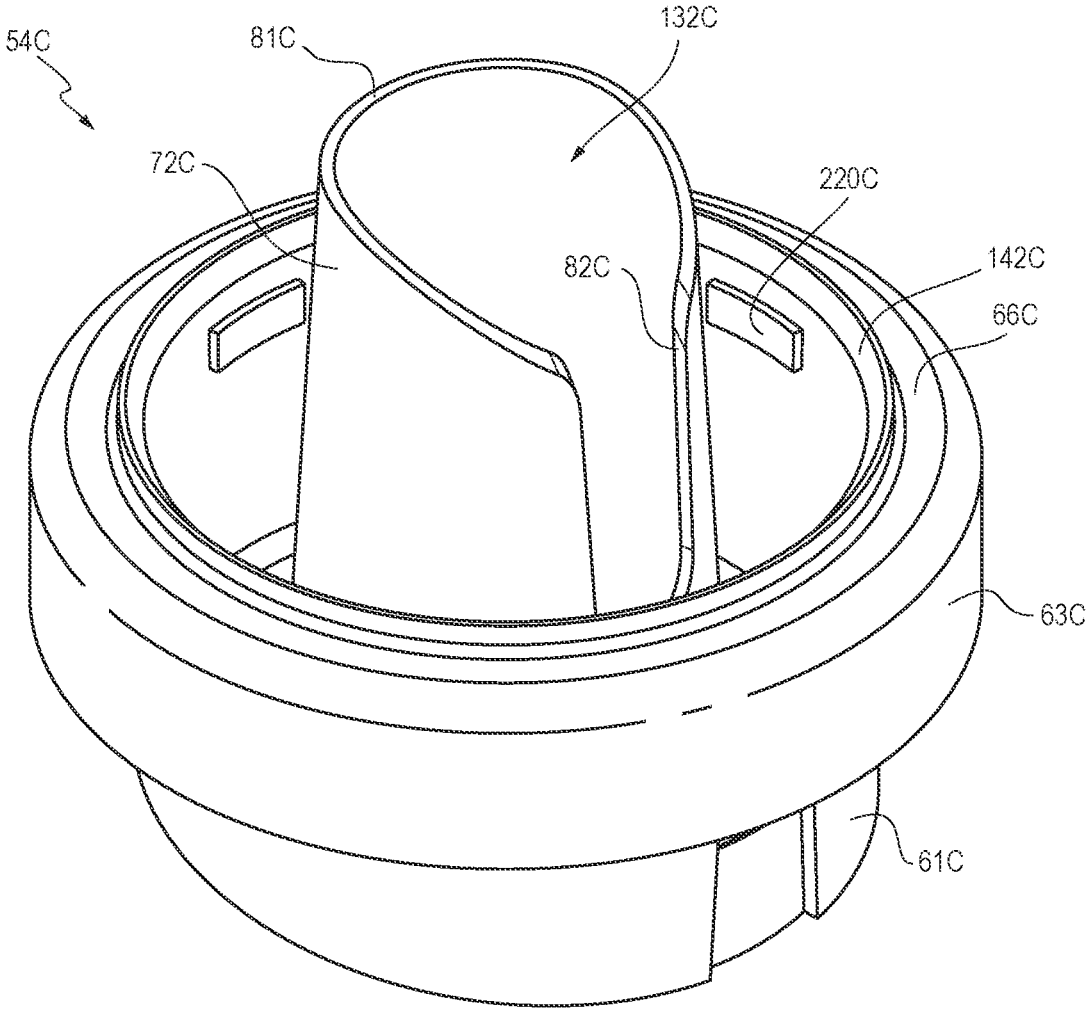
FIG. 22 is an isometric view, taken from above, of only a closure body of a fourth illustrated embodiment of a dispensing closure of the present invention.
Figure 23:
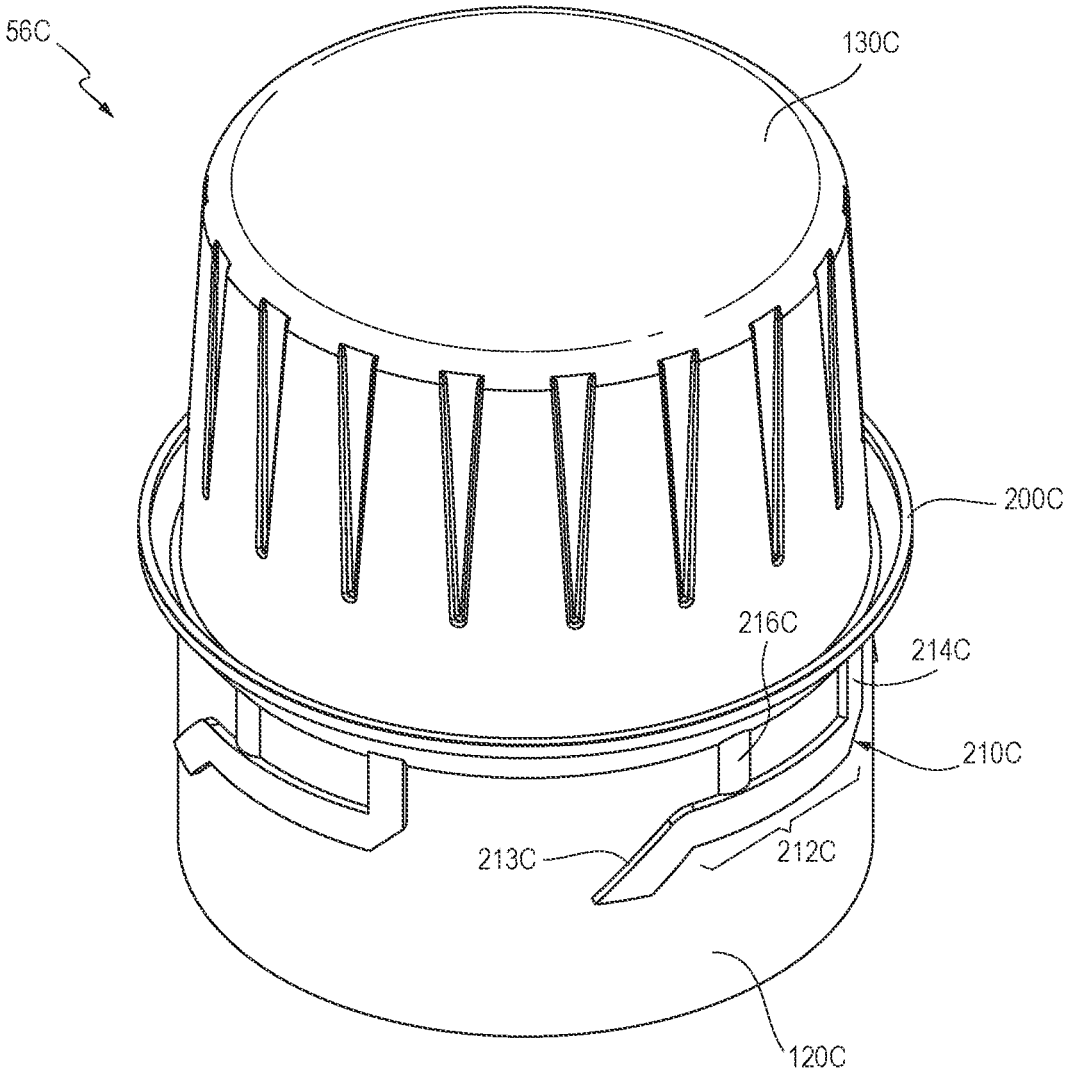
FIG. 23 is an isometric view, taken from above, of a closing element for use with the closure body of FIG. 22.
Figure 24:
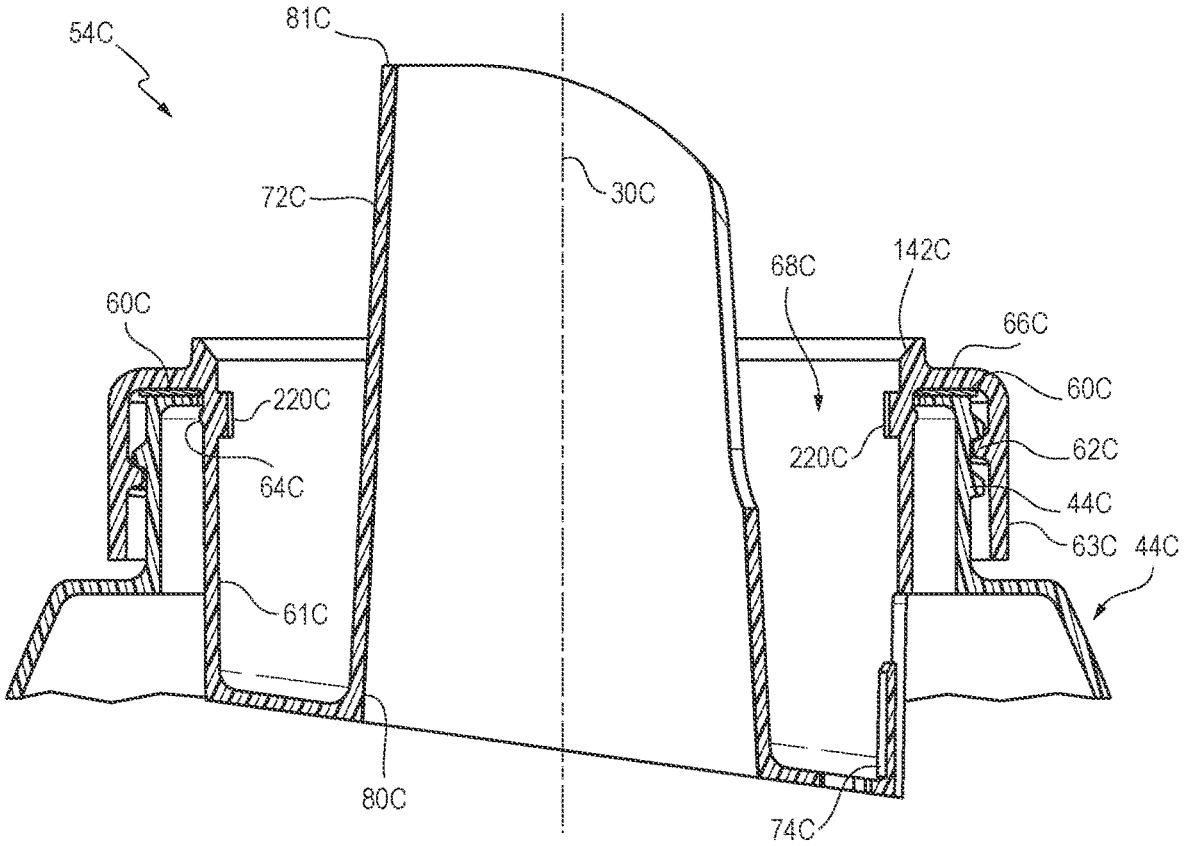
FIG. 24 is a cross-sectional view of the closure body of FIG. 22 installed with a liner at the opening of a container, taken generally along a vertical plane extending through a central axis defined by the closure.
Figure 25:
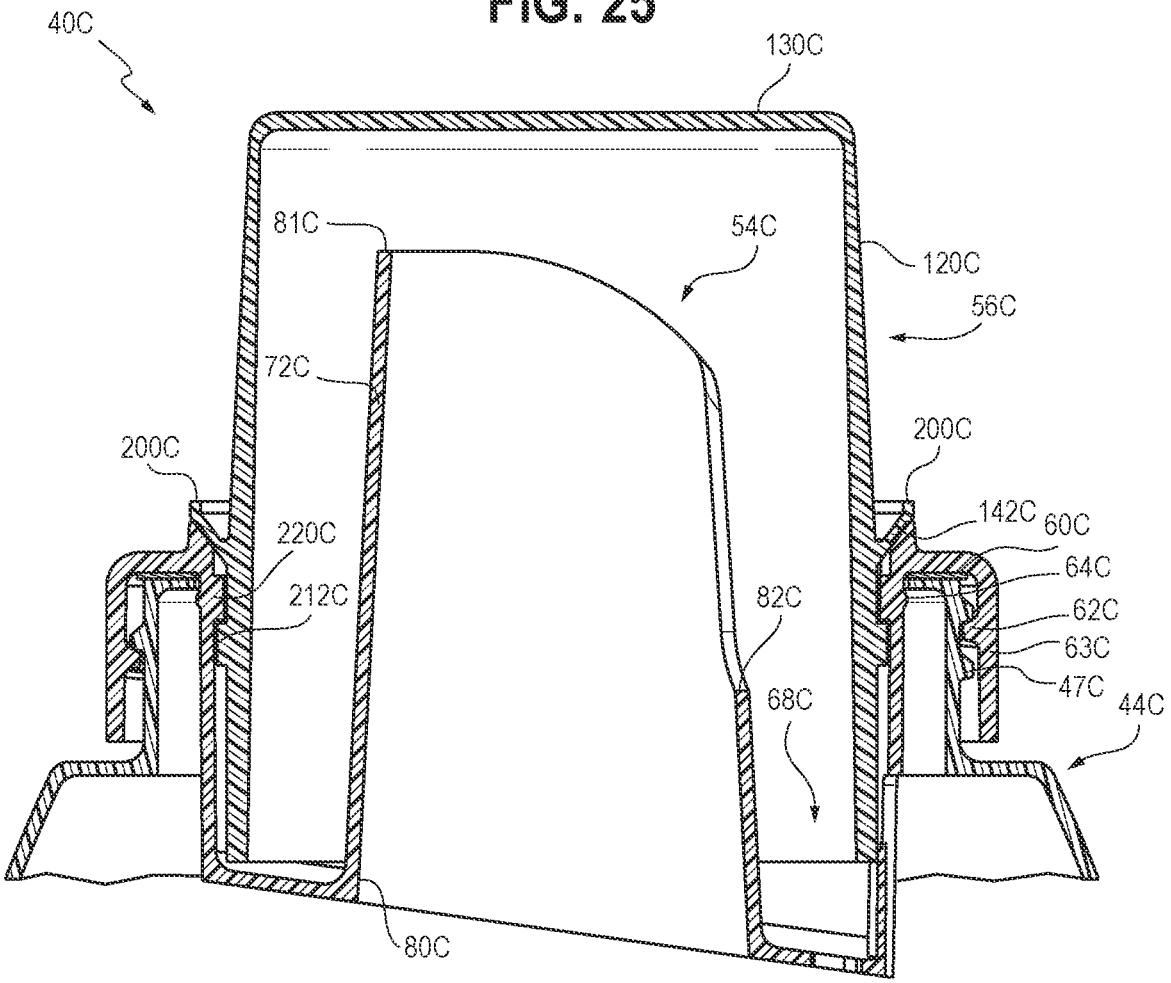
FIG. 25 is a cross-sectional view of the closure body of FIG. 22 installed with a liner and a closing element at the opening of a container, taken generally along a vertical plane extending through a central axis defined by the closure.

With reference to FIGS. 22 and 23, the closure body 54C and closing element 56C of the fourth illustrated embodiment are modified such that their respective retaining means, or structures, have been inverted. In other words, the closure body 54C includes four arcuate projections 220C that extend radially-inwardly in a plane from the wall 61C for engaging features on the closing element 56C. In turn, the closing element 56C includes four lateral projections 210C for accommodating the four arcuate projections 220C on the closure body 54C to secure the closing element 56C in its closed condition or orientation atop the closure body 54C (as seen in FIG. 25). Each of the closing element lateral projections 210C includes a circumferentially extending bottom portion 212C having an angled, open first end 213C and a closed second end in the form of an axially extending stop portion 214C. The closing element lateral projections 210C further include an abutment or ramp 216C in between the open first end 213C and the stop portion 214C. These structures effectively trap or retain the mating features of the arcuate projections 220C of the closure body 54C within an area between the ramp 216C and the stop portion 214C to prevent the closing element 56C from moving axially away from the closure body 54C, thus maintaining the compression of a crushable seal 200C with the closing element 56C installed on the closure body 54C.

With reference to FIG. 25, it can be seen that the closure body 54C and the closing element 56C of the fourth illustrated embodiment of the closure 40C are further differentiated from the prior discussed embodiments in that the closing element 56C includes a seal 200C in the form of a compliant, frustoconical, annular extension of the outer wall 1200. The closure body 54C of the closure 40C includes a frustoconical sealing surface 142C that projects axially upwardly from the top deck 66C (FIG. 24) for engaging the seal 200C. The seal 200C is preferably molded or formed unitarily with (from the same material) the closure closing element 56C, and it is sufficiently resilient to elastically deflect upwardly when engaged by the relatively more rigid sealing surface 142C. In some applications, the seal 200C could be separately molded, adhered, welded, friction fit to the closing element 56C.

Still referring to FIG. 25, with the closing element 56C installed upon the closure body 54C, the projection 220C is retained securely in the axial direction along central axis 30C (FIG. 24) in an area between the projections 210C and the seal 200C.

The closure 40C may be particularly advantageous as compared to prior art closures to provide a substantially leak-free seal between a container and the closure 40C and a substantially leak-free seal between the closure body 54C and the closing element 56C in the form of a removable measuring cup, and all of such seals may exhibit robustness to typical forces, heat, hydraulic hammer, and pressures experienced by a package containing the closure 40C and the bottle during shipping and handling of the package, particularly in e-commerce distribution chains. The formation of the seal 200C as a unitary extension of the closing element 56C may further reduce cost and manufacturing complexity when compared to other closures of the prior art. In addition, the closing element 56C may be removed by simple rotation relative to the body 54C, and no special or complex action is required by the user of the closure 40C. Furthermore, the structure of the closure 40C, prevents the seal 200C from being over-stressed when the closing element 56C is installed atop the closure body 54C.

Figure 26:
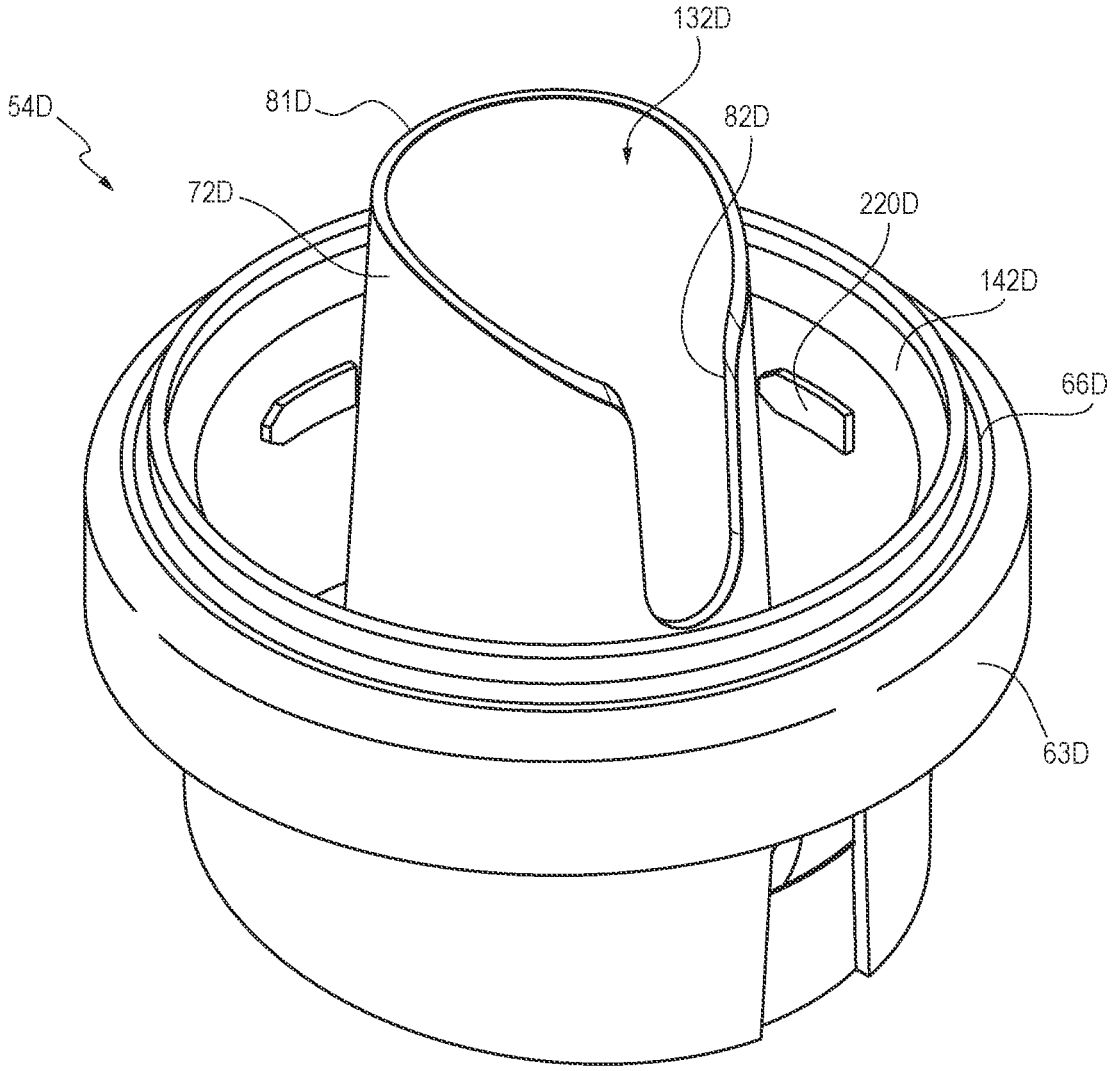
FIG. 26 is an isometric view, taken from above, of only a closure body of a fifth illustrated embodiment of a dispensing closure of the present invention.
Figure 27:
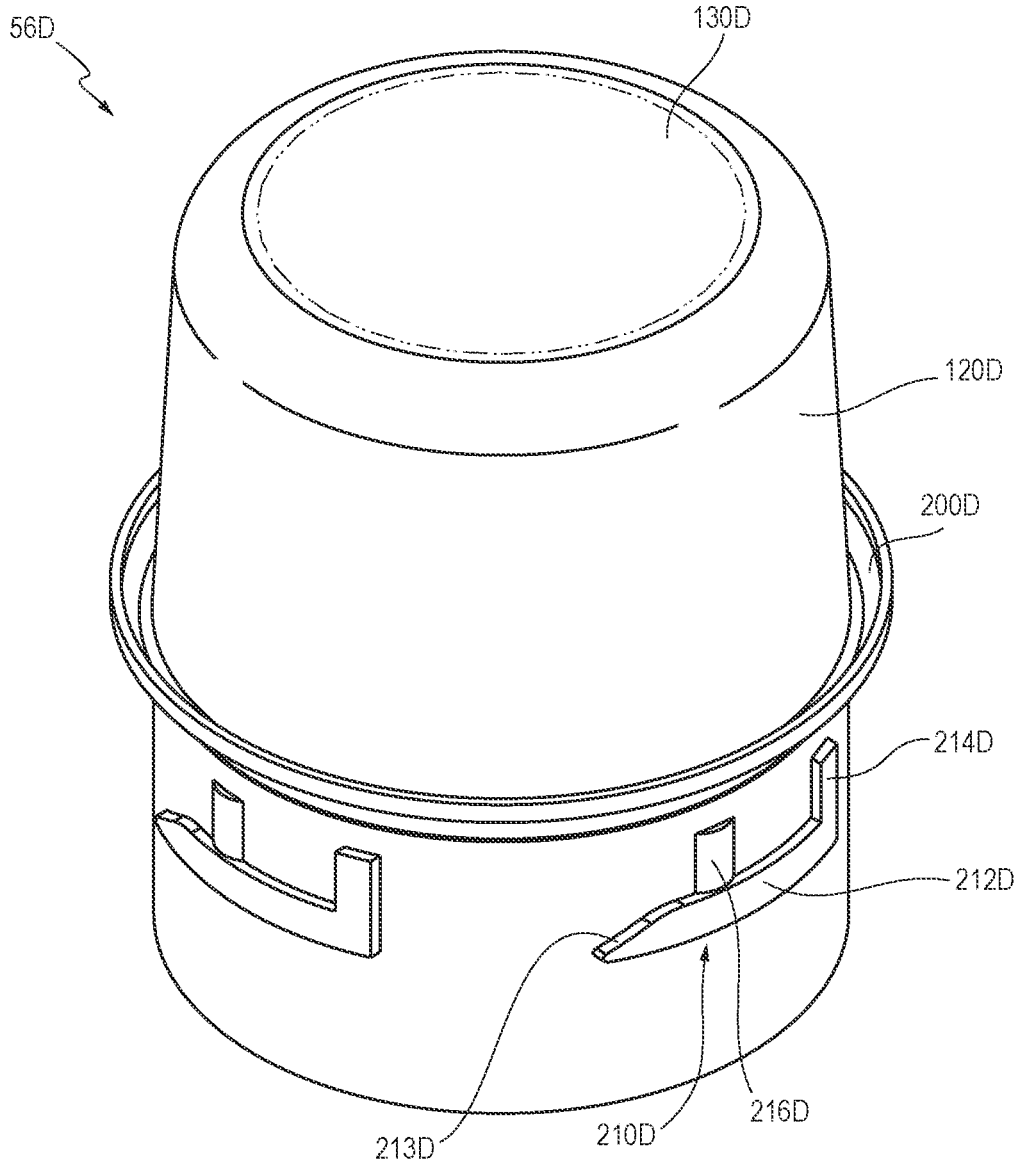
FIG. 27 is an isometric view, taken from above, of a closing element for use with the closure body of FIG. 26.
Figure 28:
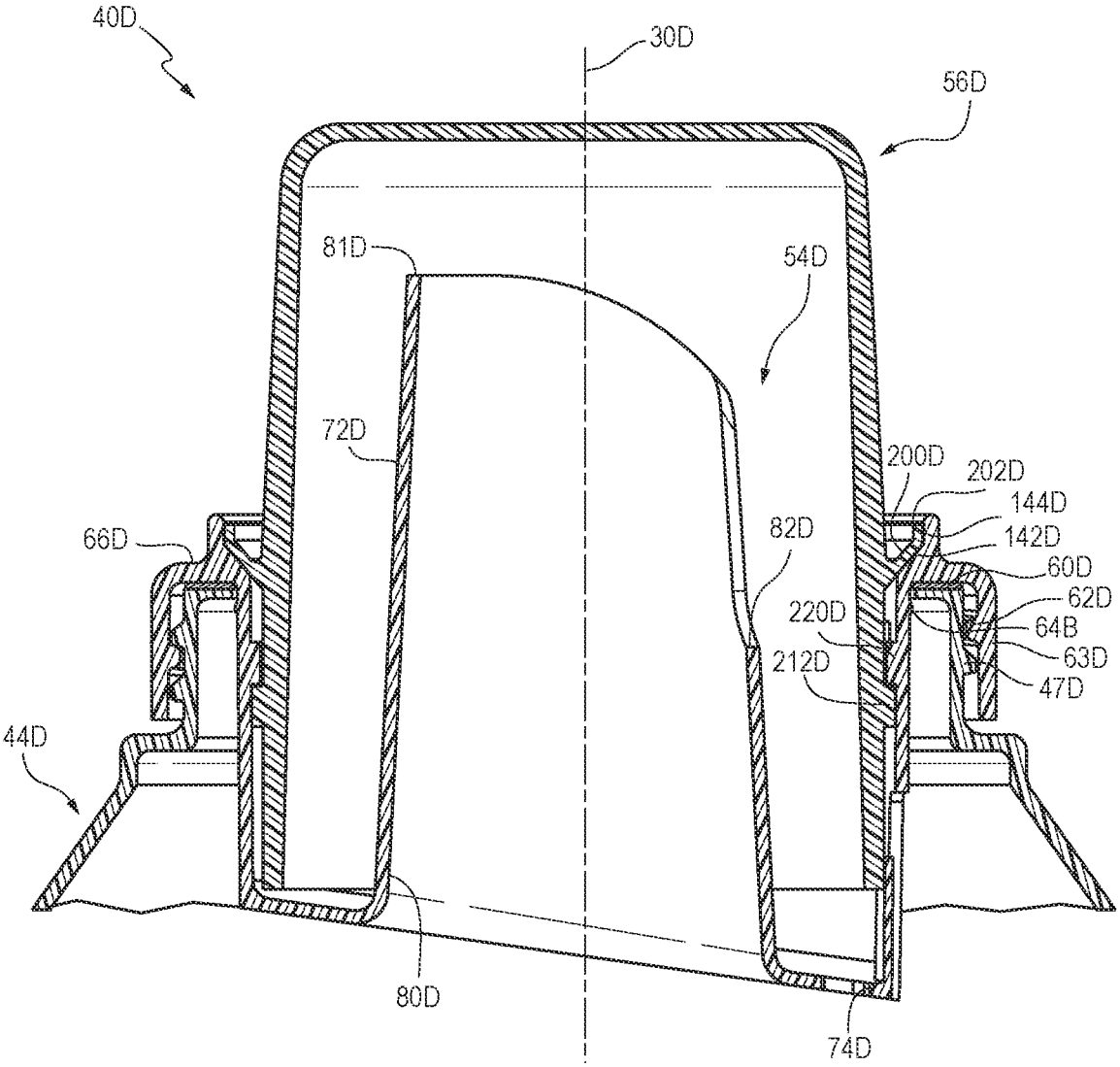
FIG. 28 is a cross-sectional view of the closure body of FIG. 26 installed with a liner and a closing element at the opening of a container, taken generally along a vertical plane extending through a central axis defined by the closure.

A fifth embodiment of a dispensing closure according to the present invention (or components thereof) is illustrated in FIGS. 26-28 and is designated generally by the numeral 40D. The numbered features of the fifth embodiment of the closure 40D illustrated in FIGS. 26-28 are analogous to features of the first embodiment of the closure 40 of FIGS. 1-12 that share the same number (but without the suffix "D"). The fifth embodiment of the closure 40D includes the basic components of a hollow closure base or body 54D (best seen in FIG. 26) for being located at the opening of a container 44D (visible in FIG. 28), a cap or closing element 56D (best seen in FIG. 27) removably or releasably connected to the body 54D, and an annular, metallic liner 60D (visible in FIG. 28) for being heat sealed or welded between the container 44D and the closure body 54D.

With reference to FIGS. 26 and 27, the closure body 54D and closing element 56D of the fifth illustrated embodiment are modified such that their respective retaining means; or structures, have been inverted (as with the fourth illustrated embodiment of the closure 40C discussed above). The closure body 54D includes four arcuate projections 220D, having a tapered lead-in surfaces, and which extend radially-inwardly from the wall 61D for engaging features on the closing element 56D. In turn, the closing element 56D includes four lateral projections 210D for accommodating the four arcuate projections 220D on the closure body 54D to secure the closing element 56D in its closed condition or orientation atop the closure body 54D (as seen in FIG. 28). Each of the closing element lateral projections 210D includes a circumferentially extending bottom portion 212D having an angled, open first end 213D and a closed second end in the form of an axially extending stop portion 214D. The lateral projections 210D further include an abutment or ramp 216D located in between the open first end 213D and the stop portion 214D. These structures effectively trap or retain the mating features of the arcuate projections 220D of the closure body 54D within an area between the ramp 216D and the stop portion 214D to prevent the closing element 56D from moving axially away from the closure body 54D, thus maintaining the compression of a flexible seal 200D with the closing element 56D installed on the closure body 54D.

With reference to FIG. 28, it can be seen that the closure body 54D and the closing element 56D of the fifth illustrated embodiment of the closure 40D are further differentiated from the prior discussed embodiments in that the closing element 56D includes a seal 200D in the form of a compliant, frustoconical, annular extension of the outer wall 120D having an axially-extending sealing portion 202D. The closure body 54D of includes a frustoconical sealing surface 142D and an annular, vertical sealing surface 144D which project axially upwardly from the top deck 66D for engaging the seal 200D. The seal 200D is preferably molded or formed unitarily with the closure closing element 56D, and it is sufficiently resilient to elastically deflect upwardly, or radially inwardly, when engaged by the relatively more rigid sealing surfaces 142D and 144D. In some applications, the seal 200D could be separately molded, adhered, welded, friction fit to the closing element 56D.

Still referring to FIG. 28, with the closing element 56D installed upon the closure body 54D, the seal 200D is forms a compound or multi-surface seal against the surfaces 142D and 144D.

The closure 40D may be particularly advantageous as compared to prior art closures to provide a substantially leak-free seal between a container and the closure 40D and a substantially leak-free seal between the closure body 54D and the closing element 56D in the form of a removable measuring cup, and all of such seals may exhibit robustness to typical forces, heat, hydraulic hammer, and pressures experienced by a package containing the closure 40D and the bottle during shipping and handling of the package, particularly in e-commerce distribution chains. The formation of the seal 200D as a unitary extension of the closing element 56D may further reduce cost and manufacturing complexity when compared to other closures of the prior art. In addition, the closing element 56D may be removed by simple rotation relative to the body 54D, and no special or complex action is required by the user of the closure 40D. Furthermore, the structure of the closure 40D prevents the seal 200D from being over-stressed when the closing element 56D is installed atop the closure body 54D.

A sixth embodiment of a dispensing closure according to the present invention (or components thereof) is illustrated in FIGS. 29-35 and is designated generally by the numeral 40E. The numbered features of the sixth embodiment of the closure 40E illustrated in FIGS. 29-35 are analogous to features of the first embodiment of the closure 40 of FIGS. 1-12 that share the same number (but without the suffix "E"). The sixth embodiment of the closure 40E includes the basic components of a hollow closure base or body 54E (best seen in FIG. 29) for being located at the opening of a container 44E (visible in FIG. 32), a cap or closing element 56E (best seen in FIG. 31) removably or releasably connected to the body 54E, and an annular, metallic liner 60E (visible in FIG. 32) for being heat sealed or welded between the container 44E and the closure body 54E.

Figure 29:
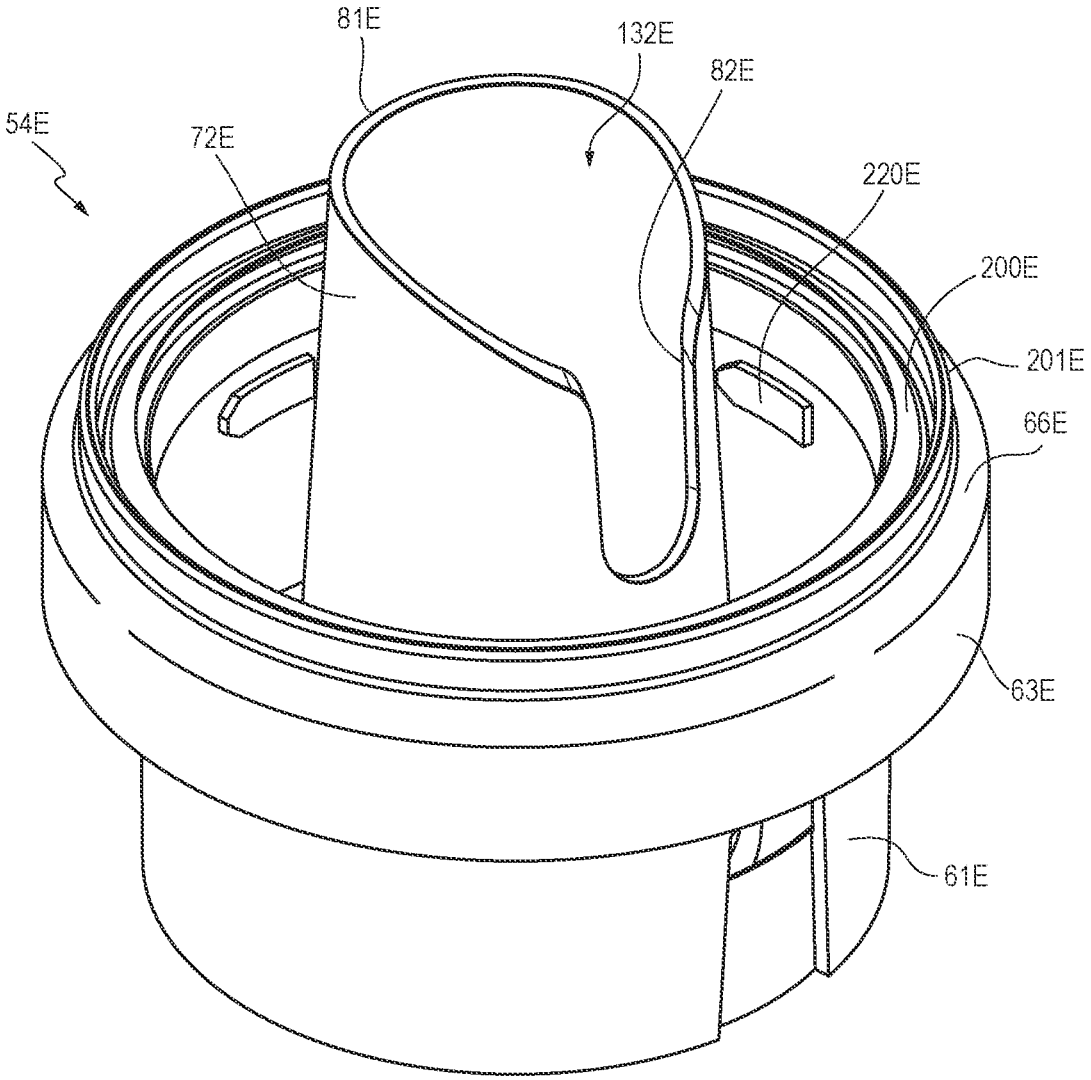
FIG. 29 is an isometric view, taken from above, of only a closure body of a sixth illustrated embodiment of a dispensing closure of the present invention.
Figure 30:
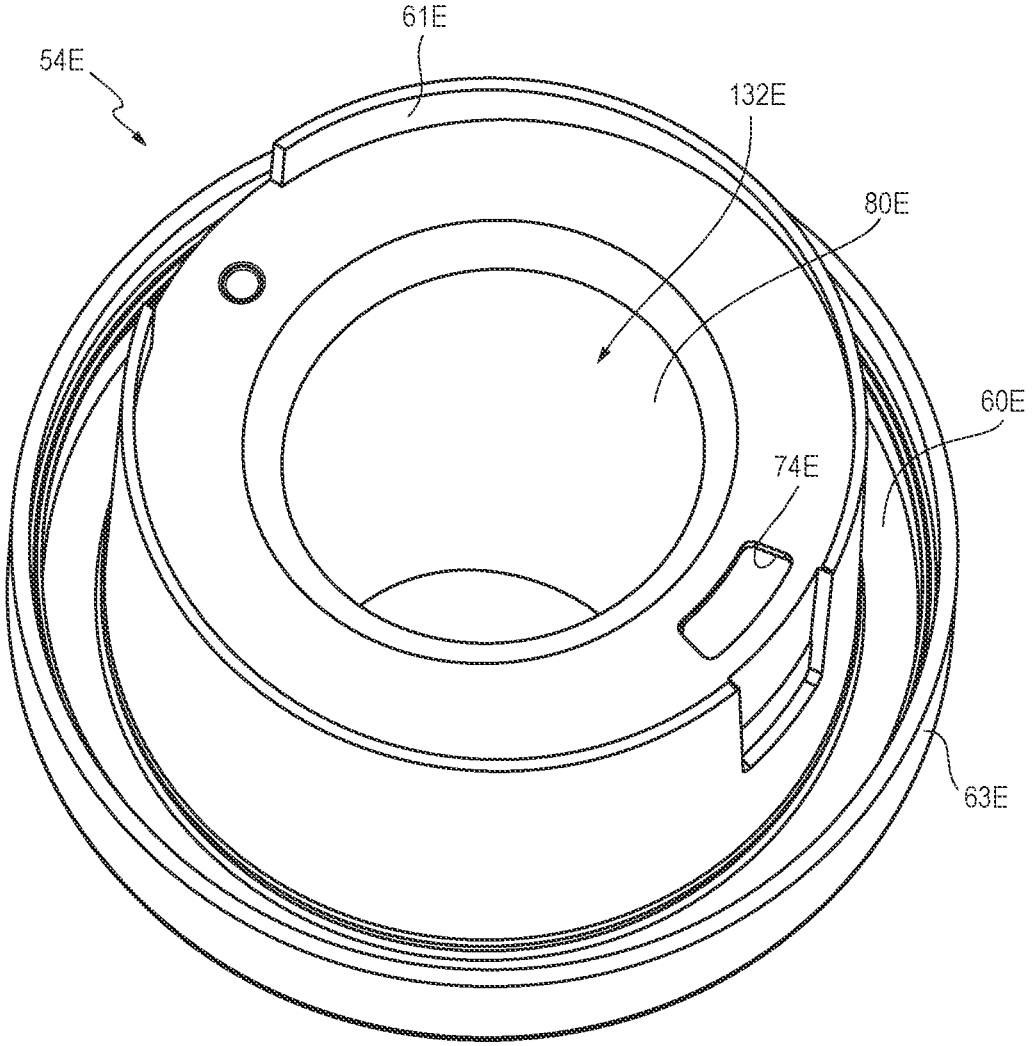
FIG. 30 is an isometric view, taken from below, of the closure body of FIG. 29.
Figure 31:
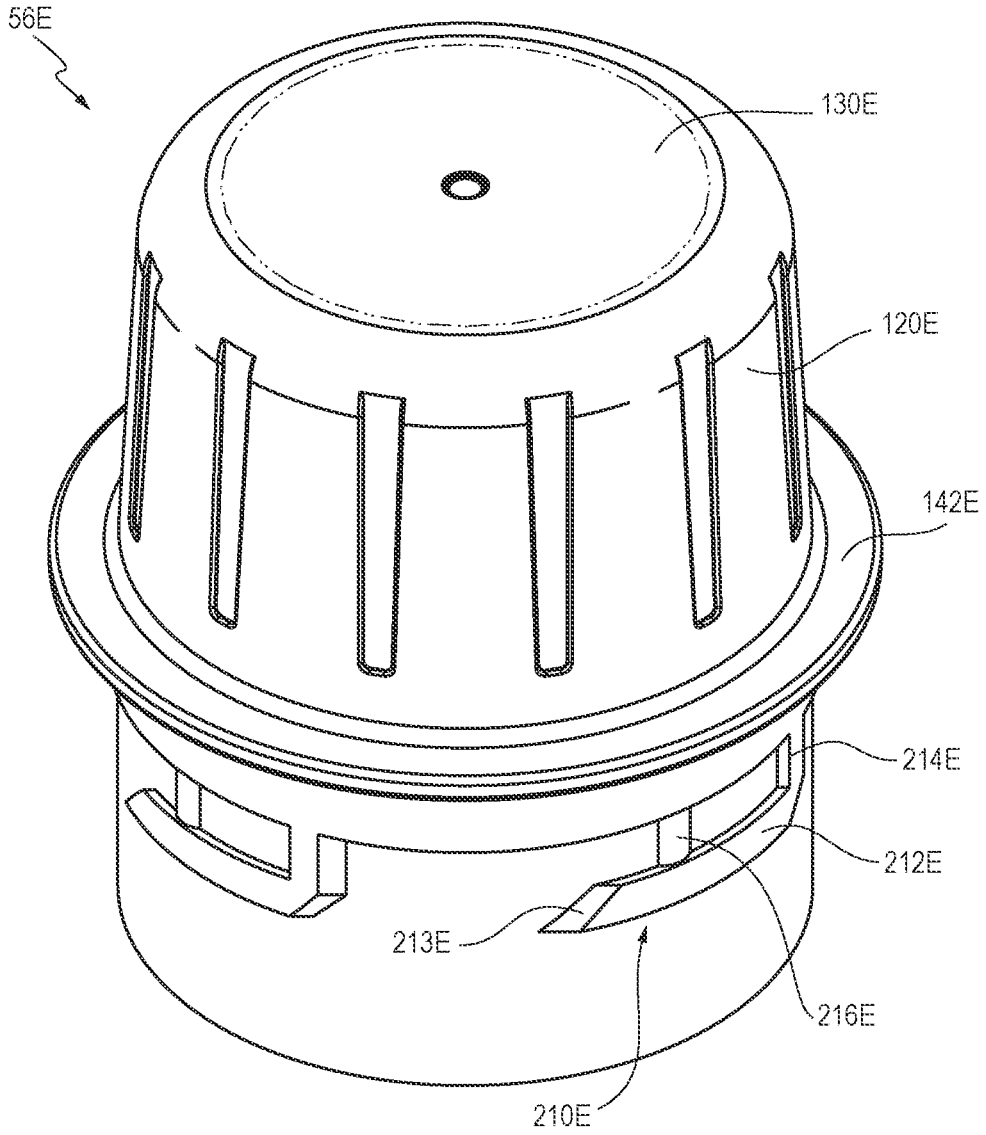
FIG. 31 is an isometric view, taken from above, of a closing element for use with the closure body of FIG. 29.
Figure 32:
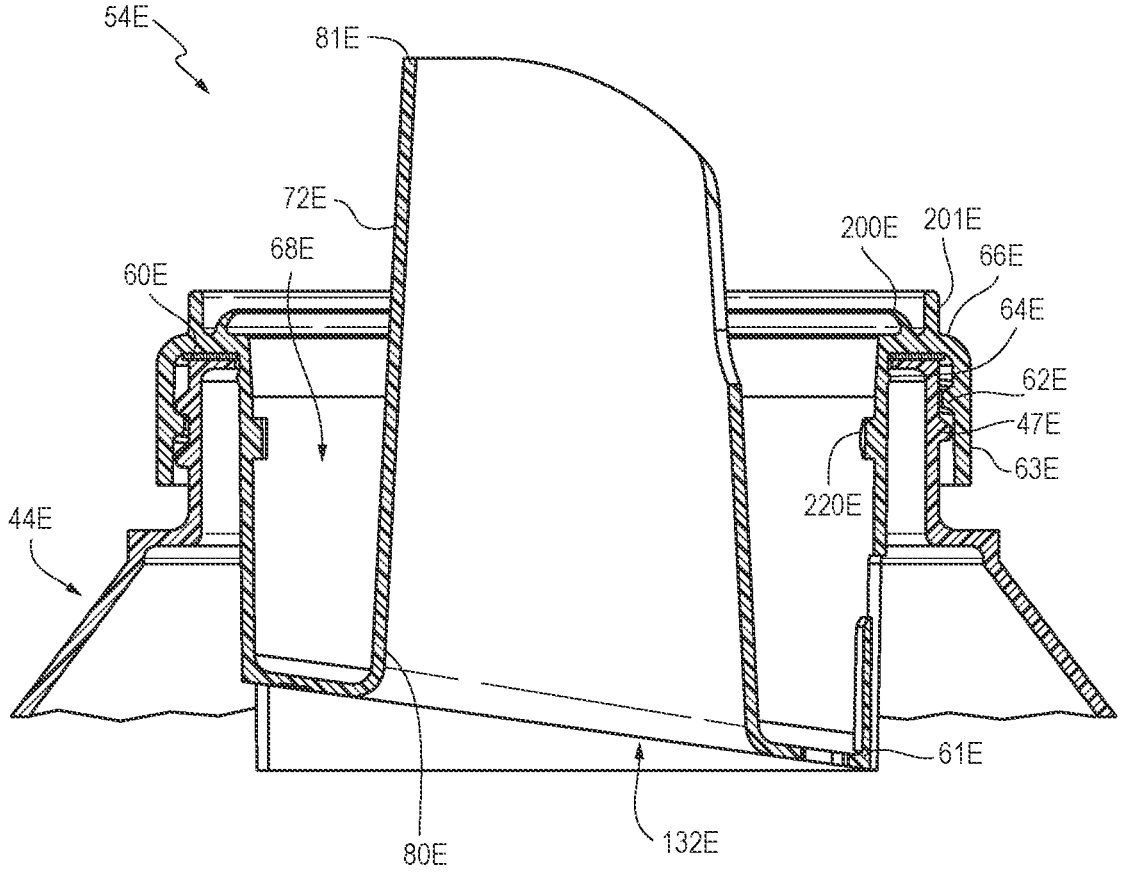
FIG. 32 is a cross-sectional view of the closure body of FIG. 29 installed with a liner at the opening of a container, taken generally along a vertical plane extending through a central axis defined by the closure.
Figure 33:
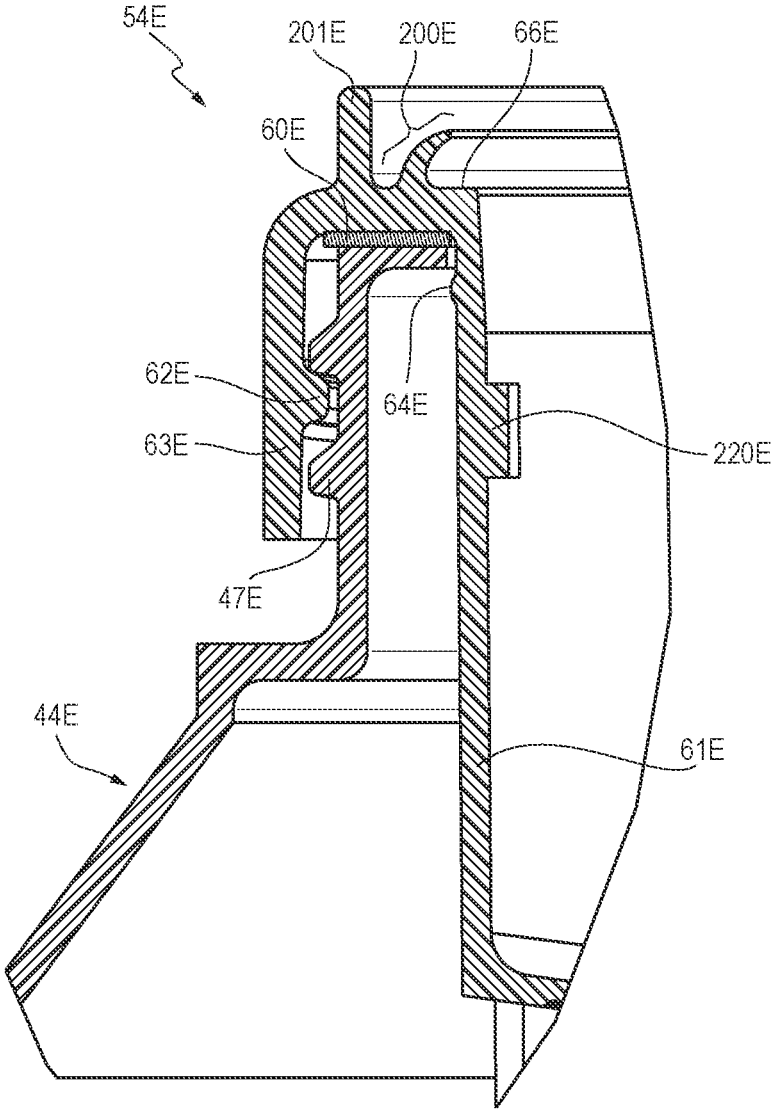
FIG. 33 is a greatly enlarged, cross-sectional view of a portion of the closure body, the liner, and the container of FIG. 32, taken generally along a vertical plane extending through a central axis defined by the closure.
Figure 34:
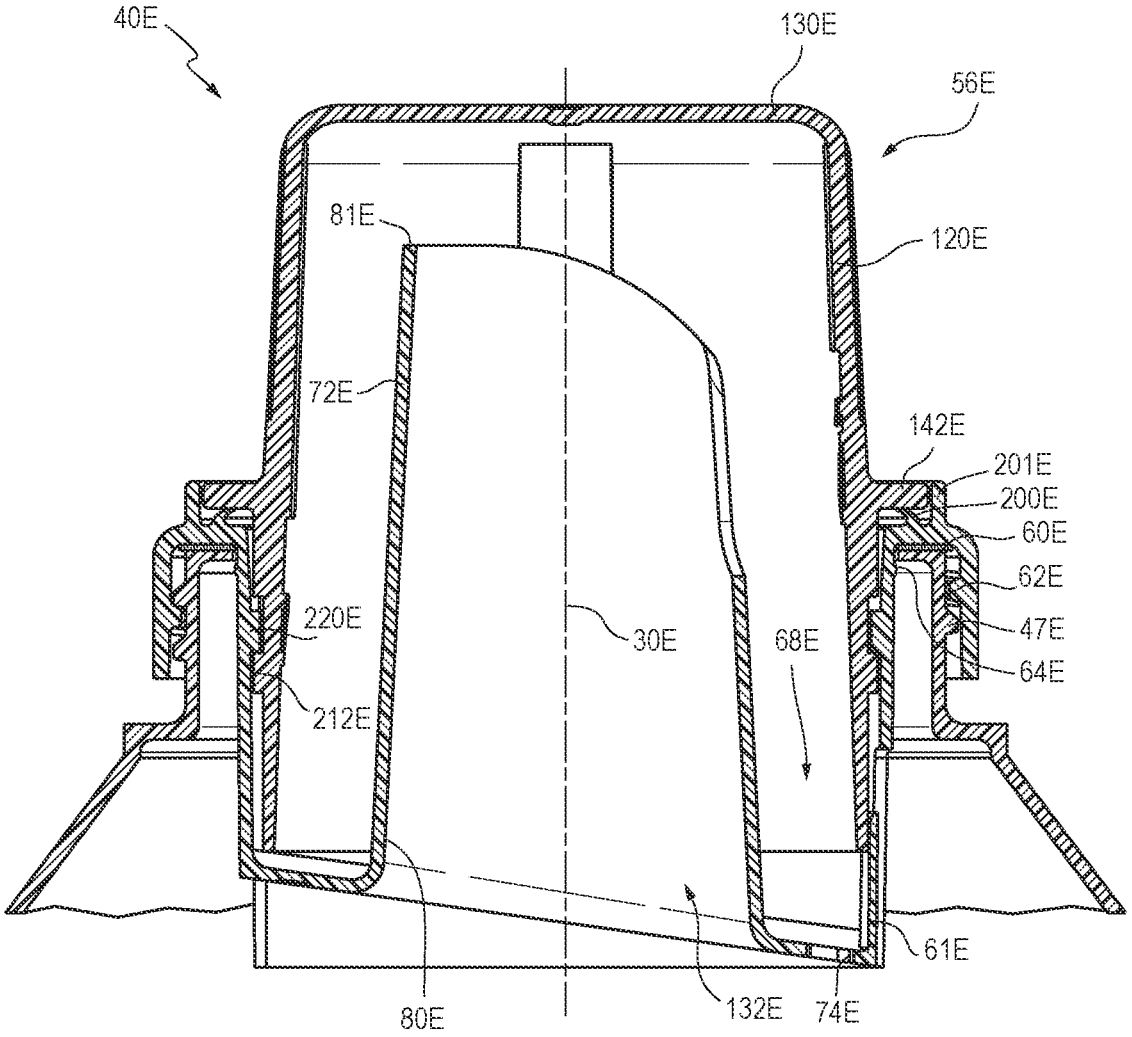
FIG. 34 is a cross-sectional view of the closure body of FIG. 29 installed with a liner and a closing element at the opening of a container, taken generally along a vertical plane extending through a central axis defined by the closure.
Figure 35:
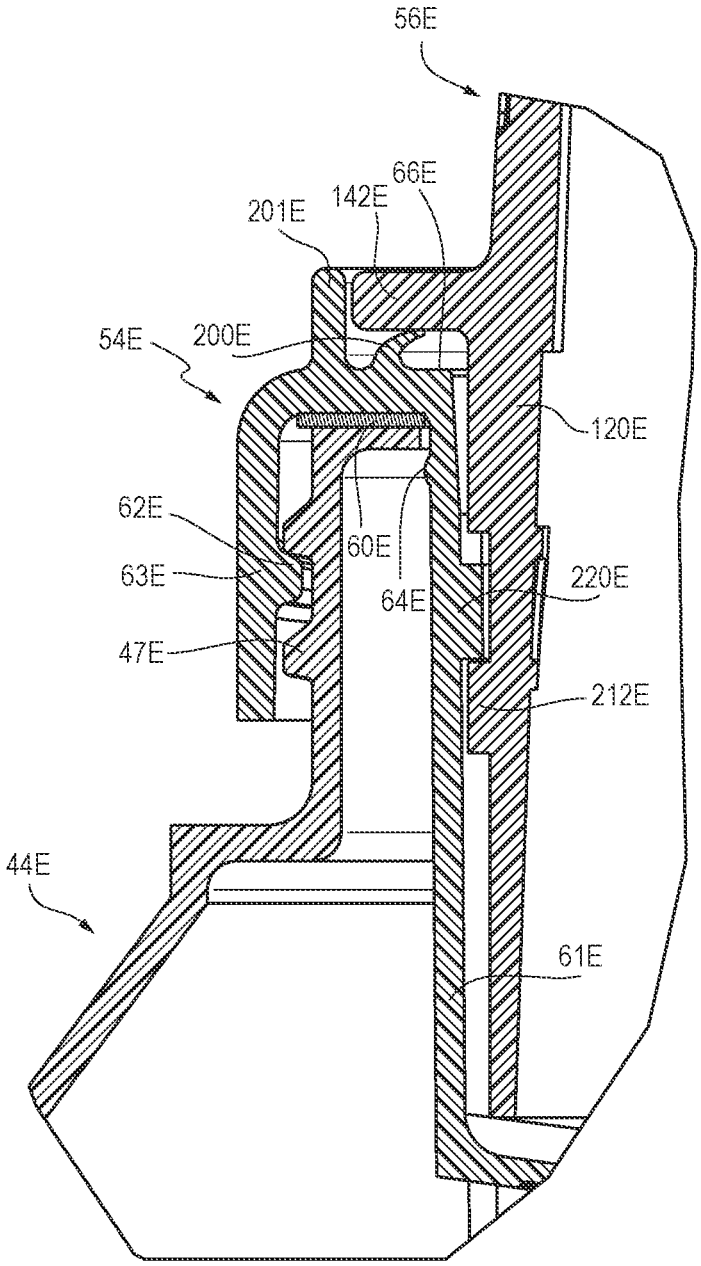
FIG. 35 is a greatly enlarged; cross-sectional view of a portion of the closure body, the liner, the closing element and the container of FIG. 34, taken generally along a vertical plane extending through a central axis defined by the closure.

With reference to FIGS. 29 and 31, the closure body 54E and closing element 56E of the sixth illustrated embodiment are modified such that their respective retaining means, or structures, have been inverted (as with the fourth illustrated embodiment of the closure 40C discussed above). The closure body 54E includes four circumferentially extending projections 220E (only two of which are visible in FIG. 29), having a tapered lead-in surfaces, that extend radially-inwardly from the wall 61E for engaging features on the closing element 56E. In turn, the closing element 56E includes four lateral projections 210E (only two of which are visible in FIG. 31) for accommodating the four arcuate projections 220E on the closure body 54E to secure the closing element 56E in its closed condition or orientation atop the closure body 54E (as seen in FIGS. 34 and 35). Each of the closing element lateral projections 210E includes a circumferentially extending bottom portion 212E having an angled, open first end 213E and a closed second end in the form of an axially extending stop portion 214E, The lateral projections 210E further include an abutment or ramp 216E located in between the open first end 213E and the stop portion 214E. These structures effectively trap or retain the mating features of the arcuate projections 220E of the closure body 54E within an area between the ramp 216E and the stop portion 214E to prevent the closing element 56E from moving axially away from the closure body 54E, thus maintaining the compression of a crushable seal 200E with the closing element 56E installed on the closure body 54E.

With reference to FIGS. 34 and 35, it can be seen that the closure body 54E and the closing element 56E of the sixth illustrated embodiment of the closure 40E are further differentiated from the prior discussed embodiments in that the closure body 54E includes a seal 200E in the form of a compliant, cantilevered, annular extension of the top deck 66E that has a convex radially outward surface and a concave radially inward surface. The closure body 54E further includes an axially-upwardly extending wall or annular rim 201E, extending from the top deck 66E, that surrounds the seal 200E. The seal 200E is preferably molded or formed unitarily with the closure body 54E, preferably from the same material as the rest of the body 54E, and it is sufficiently resilient to elastically deflect axially inwardly, and radially inwardly, when engaged by the relatively more rigid portion of the closing element 56E, In some applications, the seal 200E could be separately molded, adhered, welded, friction fit to the closure body 54E.

Still referring to FIGS. 34 and 35, the closing element 56E includes a sealing flange 142E extending radially outwardly of the outer wall 120E and defining a relatively flat lower surface for making sealing contact against the crushable seal 200E when the closing element 56E is installed upon the closure body 54E. When the closing element 56E is in its closed or installed position atop the closure body 54E, then the sealing flange 142E is recessed within the annular rim 201E of the closure body 54E to prevent impacts or torque on the closing element 56E.

The closure 40E may be particularly advantageous as compared to prior art closures to provide a substantially leak-free seal between a container and the closure 40E and a substantially leak-free seal between the closure body 54E and the closing element 56E in the form of a removable measuring cup, and all of such seals may exhibit robustness to typical forces, heat, hydraulic hammer, and pressures experienced by a package containing the closure 40E and the bottle during shipping and handling of the package, particularly in e-commerce distribution chains. The formation of the seal 200E as a unitary extension of the closure body 54E may further reduce cost and manufacturing complexity when compared to other closures of the prior art. In addition, the closing element 56E may be removed by simple rotation relative to the body 54E, and no special or complex action is required by the user of the closure 40E. Furthermore, the structure of the closure 40E prevents the seal 200E from being over-stressed (e.g., plastically deformed or sheared) when the closing element 56E is installed atop the closure body 54E.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A closure for use with a container, the container having an opening between an exterior of the container and an interior of the container where a fluent substance may be stored, said closure comprising:

A. a body for being located at the opening of the container, said body defining a central axis and having a pour spout defining an interior surface, said interior surface defining at least a portion of a passage for communicating with the container interior to permit the flow of a fluent substance through said body, said body including a flexible, crushable seal located laterally outwardly of said pour spout, said body including at least one body lateral projection extending laterally from said body;

B. a closing element for being removably attached to said body, said closing element defining i. an outer wall for being mounted around at least a portion of said pour spout of said body, ii. a cover that extends laterally inwardly from said outer wall, and iii. at least one closing element lateral projection extending laterally from said closing element; and wherein said closing element and said body have a closed condition, wherein in said closed condition (i) said flexible, crushable seal seals between said closing element and said body and (ii) said at least one body lateral projection confronts said at least one closing element lateral projection to inhibit separation of said closing element away from said body along said central axis.

2. The closure in accordance with claim 1 wherein said closure further comprises a metallic liner for being sealed between said body and a container.

3. The closure in accordance with claim 2 wherein said body includes at least one liner retention projection extending laterally outwardly therefrom for retaining said metallic liner with said body prior to said metallic liner being sealed between said body and said container.

4. The dispensing closure in accordance with claim 2 in which a portion of said body is formed from a plastic material and said flexible seal is formed from an elastomeric material that is relatively more resilient and flexible than said plastic material.

5. The closure in accordance with claim 1 wherein said flexible, crushable seal is integrally molded with said body.

6. The closure in accordance with claim 1 wherein said flexible, crushable seal has a frustoconical shape.

7. The closure in accordance with claim 1 wherein said closing element includes an outer flange having an annular sealing surface for sealing against said flexible, crushable seal of said body in said closed condition.

8. The closure in accordance with claim 1 wherein said body includes a top deck from which said flexible, crushable seal extends, said body including a recessed well located between said pour spout and said top deck.

9. The closure in accordance with claim 8 wherein said recessed well includes a drain aperture.

10. The dispensing closure in accordance with claim 1 in combination with a container of a fluent substance having a viscosity between about 40 mPa·s and about 600 mPa·s, said dispensing closure, said container, and said substance together defining a package.

11. The closure in accordance with claim 1 wherein said closure further comprises a ring-shaped metallic liner located axially inwardly of said flexible, crushable seal relative to said central axis.

12. The closure in accordance with claim 1 wherein said flexible, crushable seal has an arcuate shape, extending from a top deck of said body, defining a radially inwardly facing convex surface and a radially outwardly facing concave surface.

13. The closure in accordance with claim 1 wherein closing element includes an annular projection for surrounding said flexible, crushable seal when said closing element is in said closed position.

14. The closure in accordance with claim 1 wherein said flexible, crushable seal has an arcuate shape, extending from a top deck of said body, defining a radially inwardly facing concave surface and a radially outwardly facing convex surface.

15. The closure in accordance with claim 1 wherein body includes an annular rim surrounding said flexible, crushable seal and extending axially outwardly of a sealing surface of said closing element in said closed position.

16. The closure in accordance with claim 1 wherein said at closing element lateral projection includes a circumferentially-extending portion having an open first end and a closed second end including an axially-extending stop portion.

17. The closure in accordance with claim 16 wherein said closing element includes at least one ramp proximate to said open first end of said circumferentially-extending portion for limiting rotation of said closing element relative to said body in said closed condition.

* * * * *